US010081940B2

(12) United States Patent
Schabel, Jr.

(10) Patent No.: US 10,081,940 B2
(45) Date of Patent: Sep. 25, 2018

(54) STRUCTURAL ASSEMBLY INSULATION

(71) Applicant: Schabel Polymer Technology, LLC, Rocky River, OH (US)

(72) Inventor: Norman G. Schabel, Jr., Rocky River, OH (US)

(73) Assignee: Schabel Polymer Technology, LLC, Rocky River, OH (US)

( * ) Notice: Subject to any disclaimer, the term of this patent is extended or adjusted under 35 U.S.C. 154(b) by 122 days.

(21) Appl. No.: 14/948,966

(22) Filed: Nov. 23, 2015

(65) Prior Publication Data

US 2016/0076244 A1 Mar. 17, 2016

Related U.S. Application Data

(62) Division of application No. 13/795,155, filed on Mar. 12, 2013, now Pat. No. 9,222,254.

(60) Provisional application No. 61/609,944, filed on Mar. 13, 2012.

(51) Int. Cl.

| | |
|---|---|
| ***E04B 1/74*** | (2006.01) |
| ***E04B 1/90*** | (2006.01) |
| ***E04B 1/76*** | (2006.01) |
| ***E04B 5/26*** | (2006.01) |
| ***E04B 1/62*** | (2006.01) |

(52) U.S. Cl.

CPC ..... *E04B 1/7654* (2013.01); *E04B 1/62* (2013.01); *E04B 1/74* (2013.01); *E04B 1/7604* (2013.01); *E04B 1/90* (2013.01); *E04B 5/261* (2013.01); *E04B 2001/742* (2013.01); *E04B 2001/745* (2013.01); *E04B 2001/746* (2013.01)

(58) Field of Classification Search

CPC . E04B 1/62; E04B 1/74; E04B 1/7604; E04B 1/7654; E04B 1/80; E04B 1/90; E04B 2001/742; E04B 2001/745; E04B 2001/746; E04B 5/261; B29K 2105/165; E04F 21/085; E04C 2/284

See application file for complete search history.

(56) References Cited

U.S. PATENT DOCUMENTS

| | | | | |
|---|---|---|---|---|
| 5,765,330 | A * | 6/1998 | Richard | E04B 1/14 52/265 |
| 6,662,516 | B2 * | 12/2003 | Vandehey | E04B 1/7604 52/309.5 |
| 7,770,691 | B2 * | 8/2010 | Schabel, Jr. | B60R 13/08 181/259 |
| 2002/0073641 | A1 * | 6/2002 | Menchetti | E04B 2/7411 52/404.1 |
| 2005/0055973 | A1 * | 3/2005 | Hagen, Jr. | E04B 1/7604 52/741.1 |
| 2006/0000155 | A1 * | 1/2006 | Wagner | E04B 1/7604 52/22 |

(Continued)

*Primary Examiner* — Ryan D Kwiecinski

(74) *Attorney, Agent, or Firm* — Martin M. Kilbane; Wentsler LLC

(57) ABSTRACT

A structural assembly (20) providing both a surface (21) and an insulating stratum associated with the surface. The assembly (20) can comprise structural members (23-24) and pods (30) associated with the structural members (23-24). The pods (30) contribute to structural integrity, thermal insulation, and/or sound attenuation. The pods or pod-like material can be used in or on horizontal or vertical cavities, in or on horizontal or vertical surfaces, and/or incorporated into a structural assembly or equipment housing.

20 Claims, 57 Drawing Sheets

(56) References Cited

U.S. PATENT DOCUMENTS

2007/0074474 A1* 4/2007 Jannelle ..... E04B 1/7604
52/309.4
2007/0227814 A1* 10/2007 Schabel, Jr. ..... B60R 13/08
181/288
2008/0289286 A1* 11/2008 Letton ..... E04B 1/161
52/741.15
2009/0246445 A1* 10/2009 Peterson ..... B29B 17/00
428/68
2010/0050562 A1* 3/2010 Kasboske ..... B29C 70/66
52/742.1
2014/0137497 A1* 5/2014 Bahnmiller ..... B32B 5/14
52/309.4

* cited by examiner

Figures 7A, 7B, 7C:
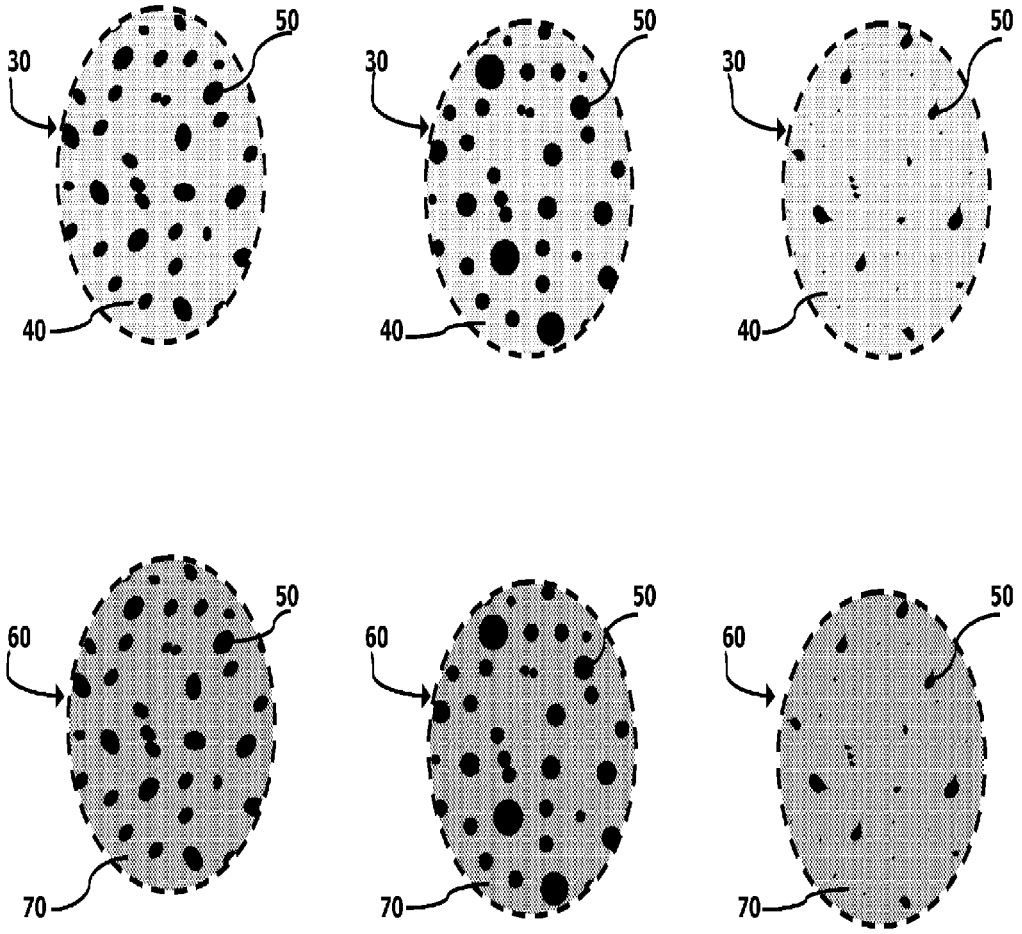
Figure 7G:
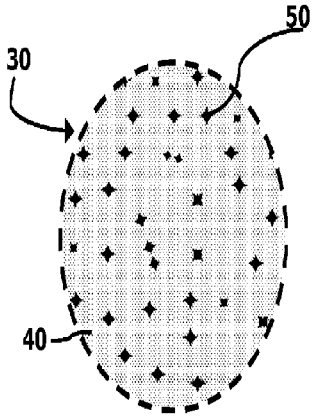
Figure 7G:
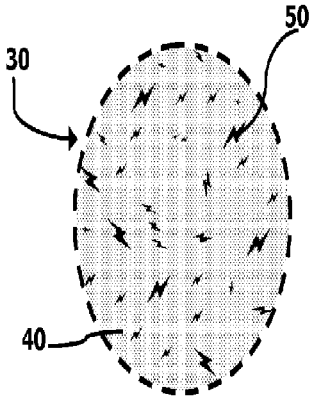
Figure 7G:
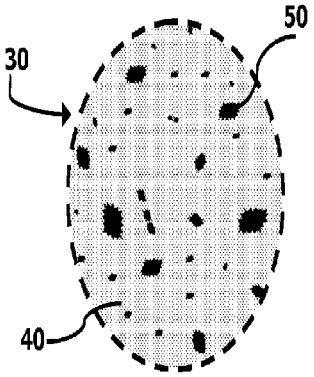
Figure 7G:
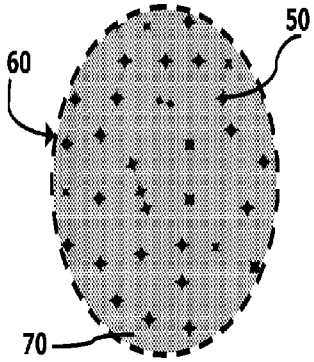
Figure 7H:
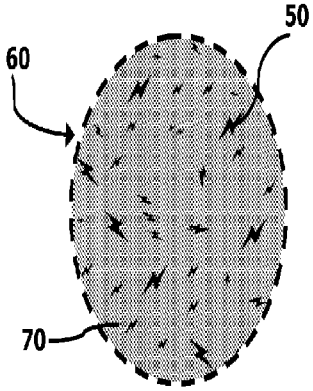
Figure 7I:
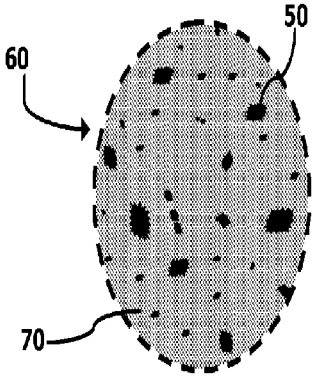
Figure 7J:
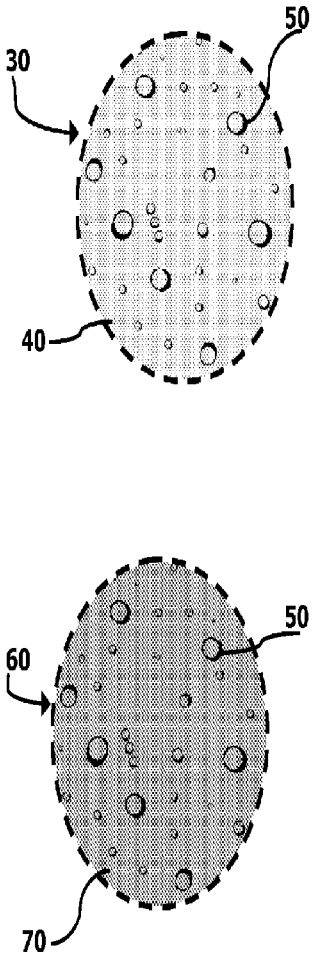
Figure 7K:
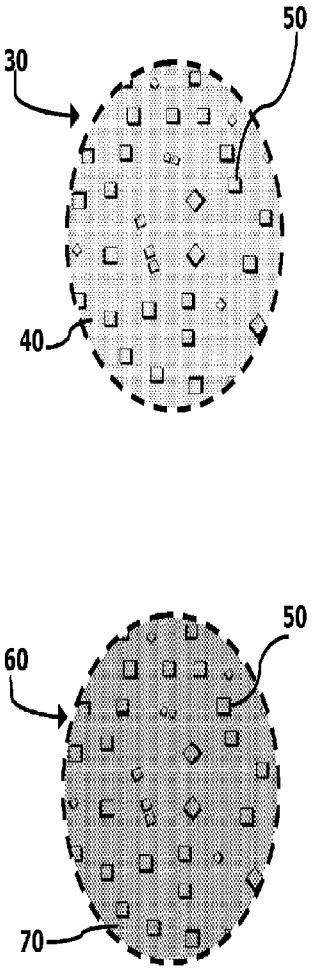
Figure 7L:
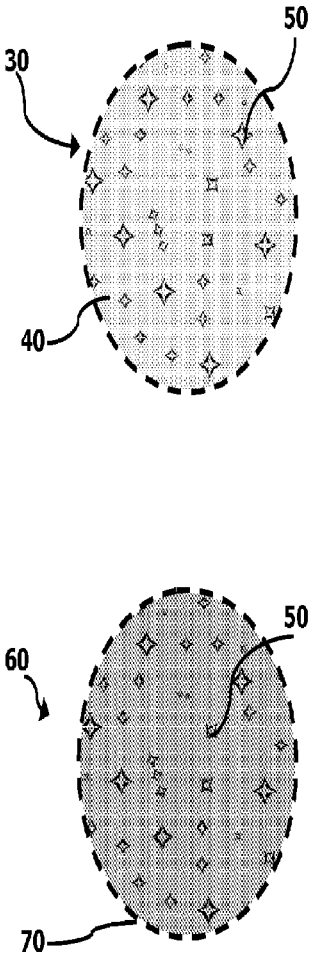

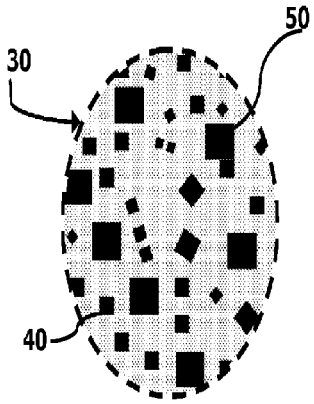
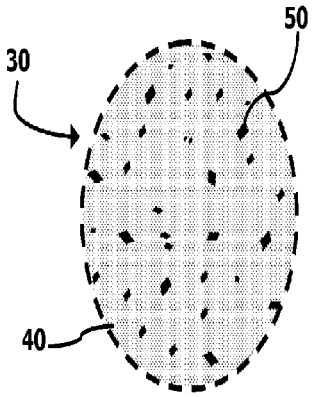
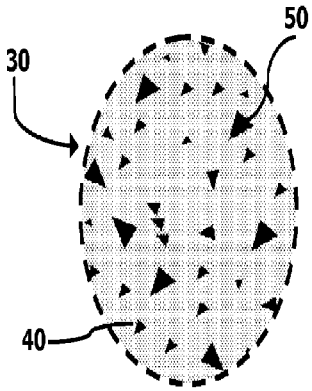
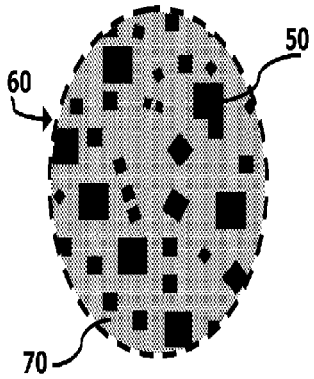
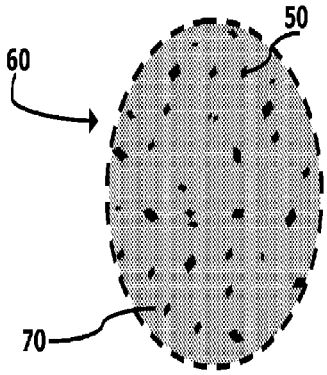
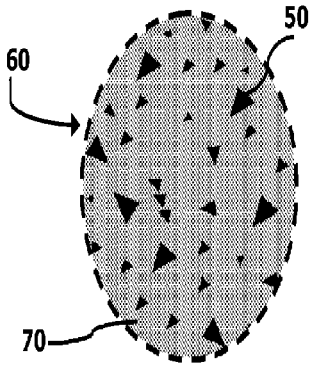
FIGURE 7D FIGURE 7E FIGURE 7F

Figures 8A, 8B, 8C:
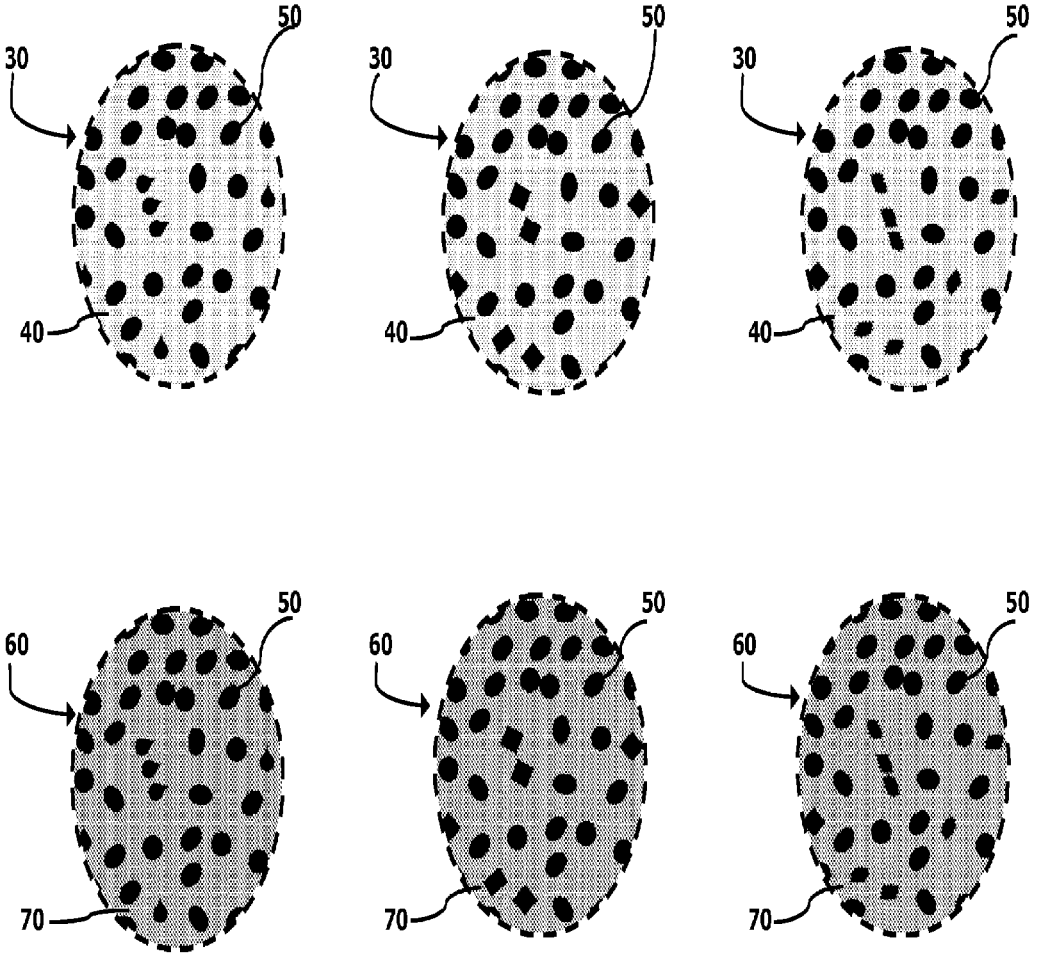
Figure 8J:
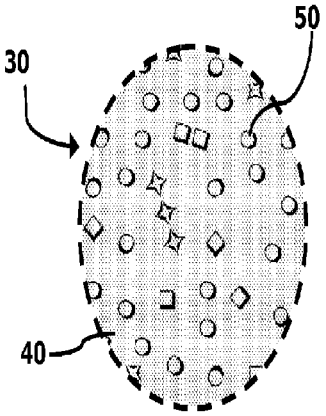
Figure 8J:
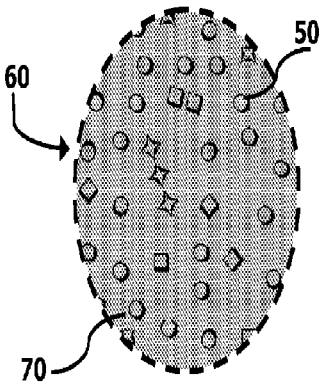
Figure 8K:
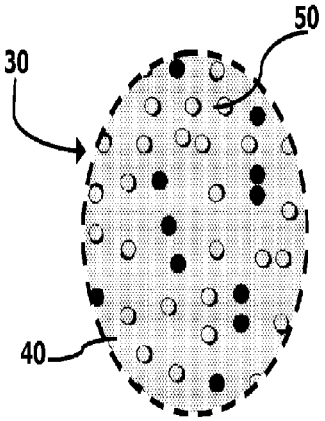
Figure 8K:
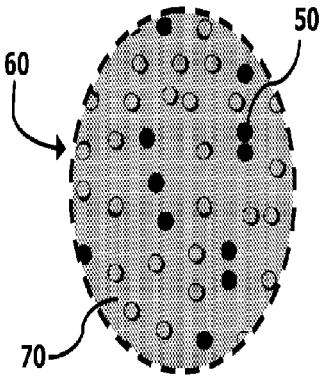
Figure 8L:
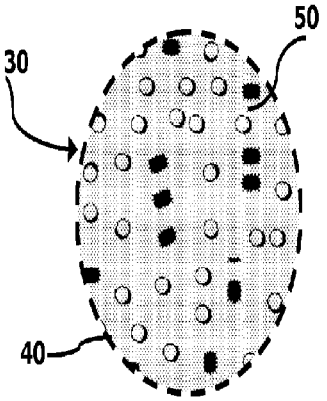
Figure 8L:
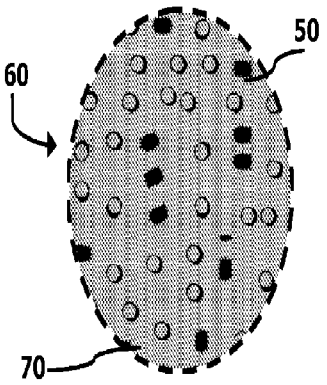

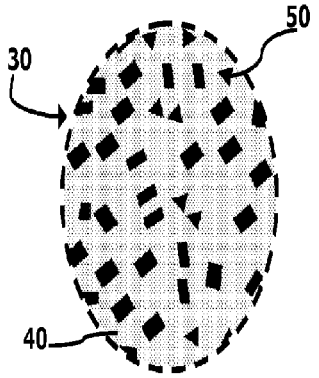
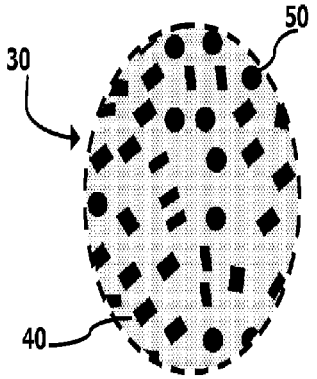
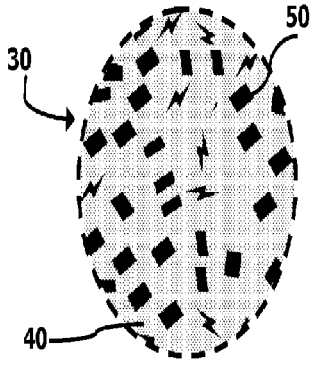
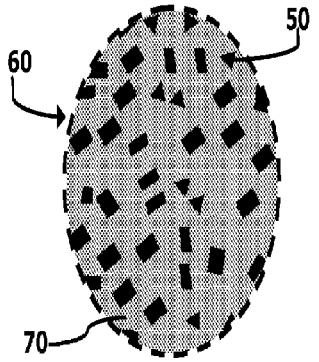
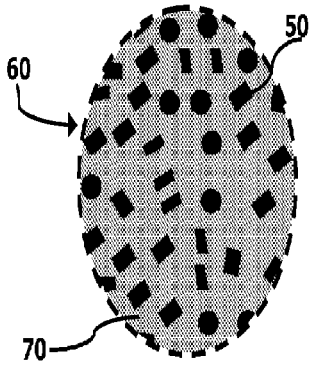
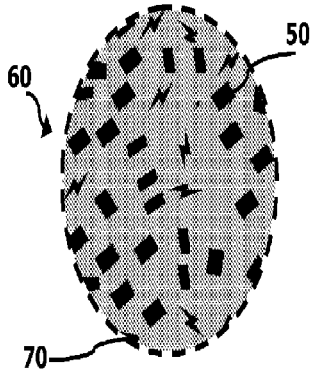
FIGURE 8D FIGURE 8E FIGURE 8F

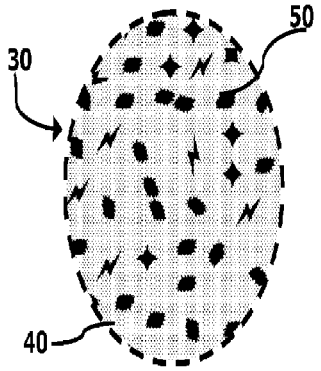
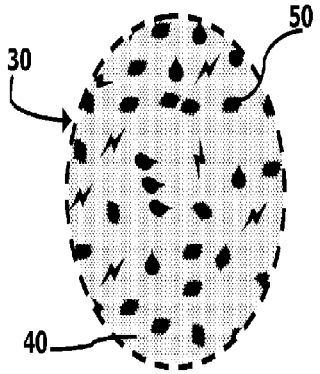
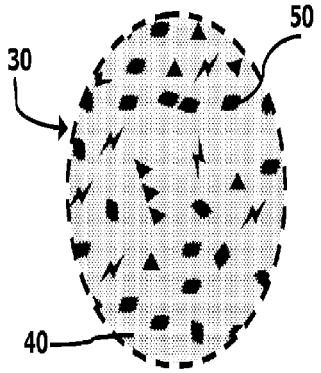
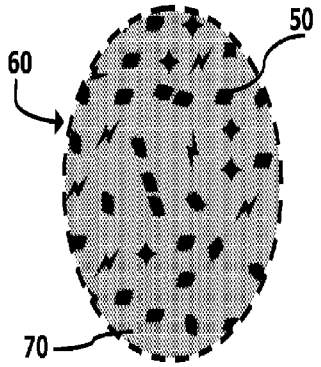
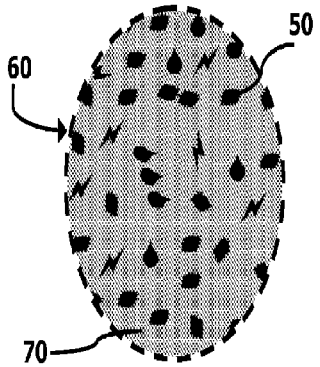
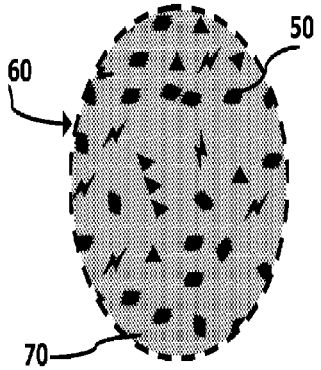
FIGURE 8G FIGURE 8H FIGURE 8I

Figure 9A:
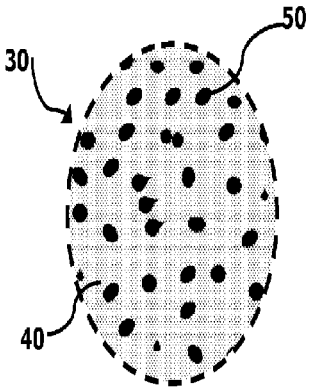
Figure 9A:
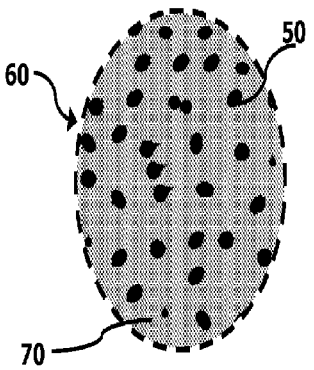
Figure 9B:
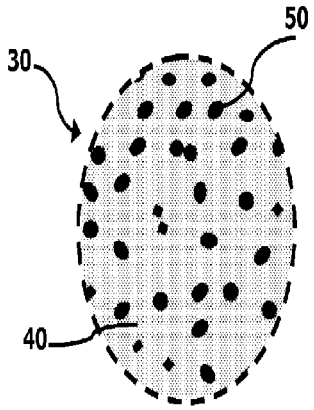
Figure 9B:
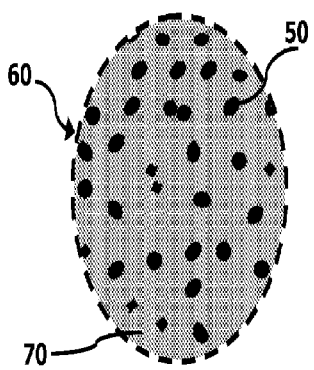
Figure 9C:
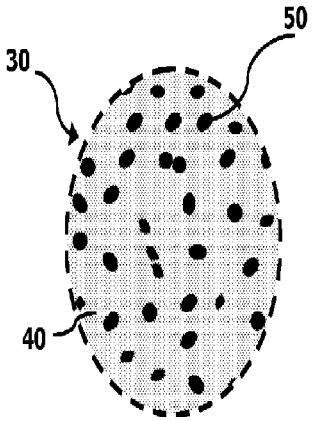
Figure 9C:
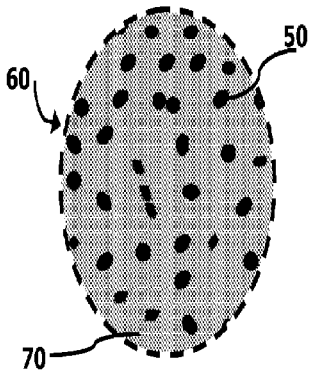
Figure 9D:
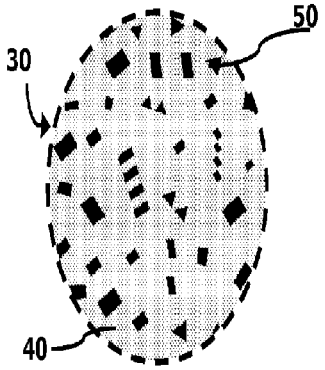
Figure 9D:
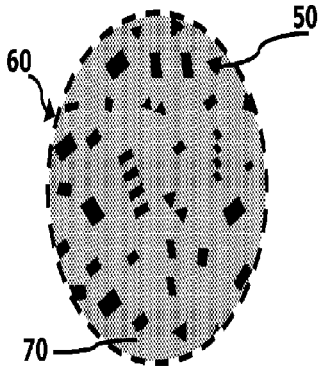
Figure 9E:
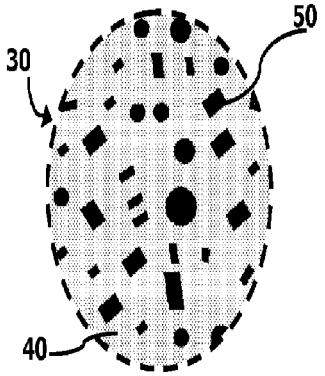
Figure 9E:
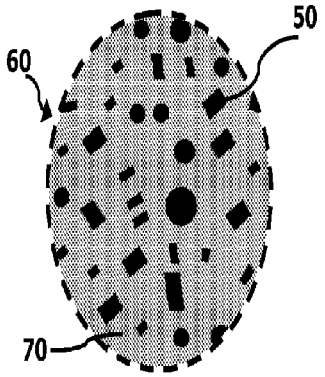
Figure 9F:
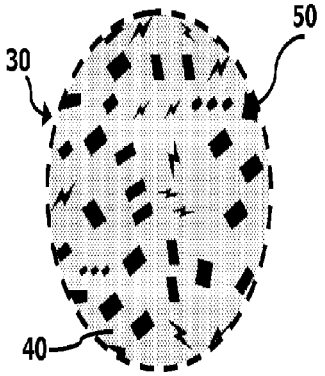
Figure 9F:
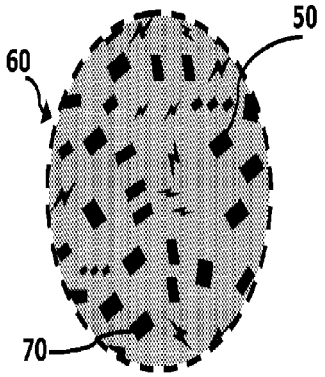

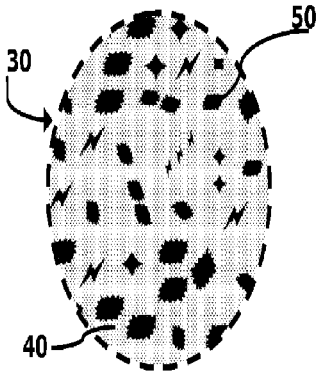
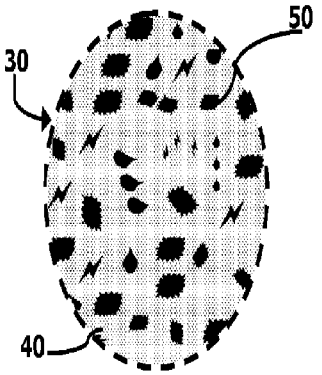
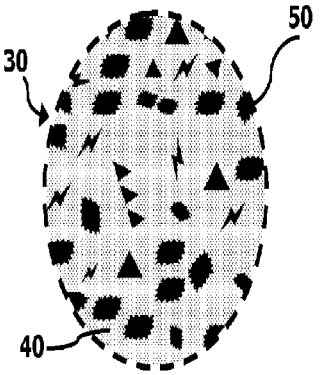
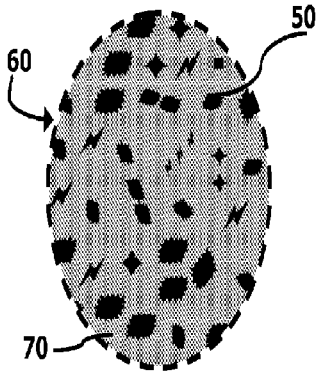
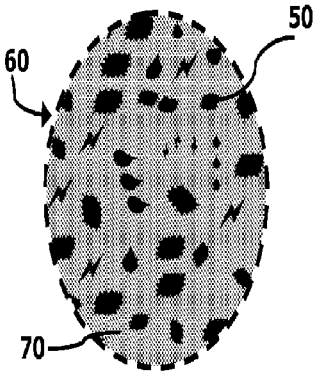
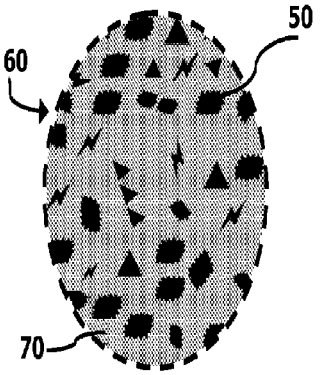
FIGURE 9G FIGURE 9H FIGURE 9I

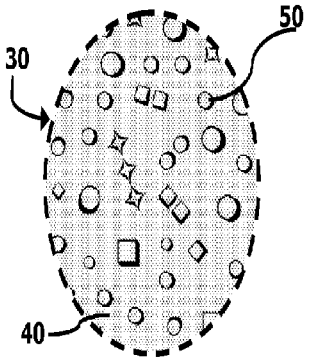
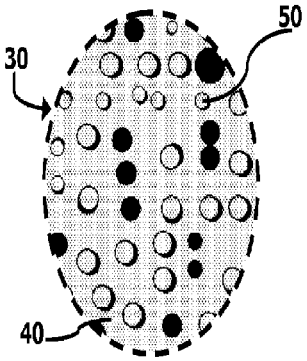
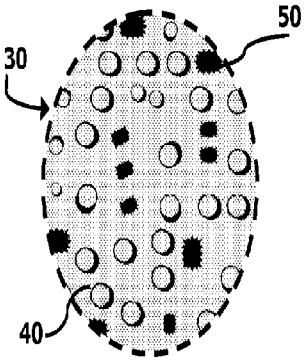
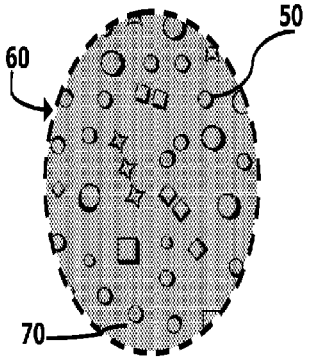
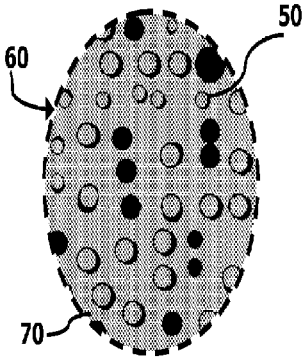
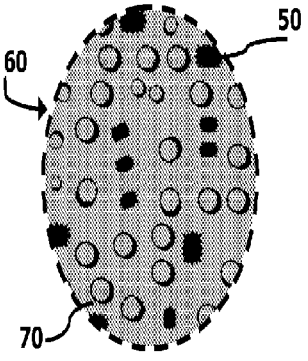
FIGURE 9J FIGURE 9K FIGURE 9L

STRUCTURAL ASSEMBLY INSULATION

CROSS-REFERENCE TO RELATED APPLICATIONS

This application is a divisional of and claims priority to U.S. Non-Provisional patent application Ser. No. 13/795,155 filed on Mar. 12, 2013, which claimed priority under 35 USC 119(e) to U.S. Provisional Patent Application No. 61/609,944 filed on Mar. 13, 2012. The entire disclosures of these applications are hereby incorporated by reference.

BACKGROUND

A building can include a floor assembly or vertical wall cavity comprising a series of joists extending perpendicularly between supporting members such as walls, beams, and/or girders. In a residential home setting, for example, the attic joists and supporting members typically form a grid of rectangular cavities. These cavities are usually about 4 to about 16 inches deep, about 10 to about 30 inches wide, and about 4 to about 20 feet long.

SUMMARY

A structural assembly includes cavity-occupying pods which contribute both to its load-supporting capacity and thermal-insulating ability. The pods each include solidified carrier with pellets dispersed therein and are created by fluidly introducing a pod-making material into the cavities. The volume of each pod is substantially equal to the volume of the introduced pod-making material, and remains so for an extended time period (e.g., at least 5 years, at least 10 years, at least 20 years, etc.).

FIGURES

Figure 1:
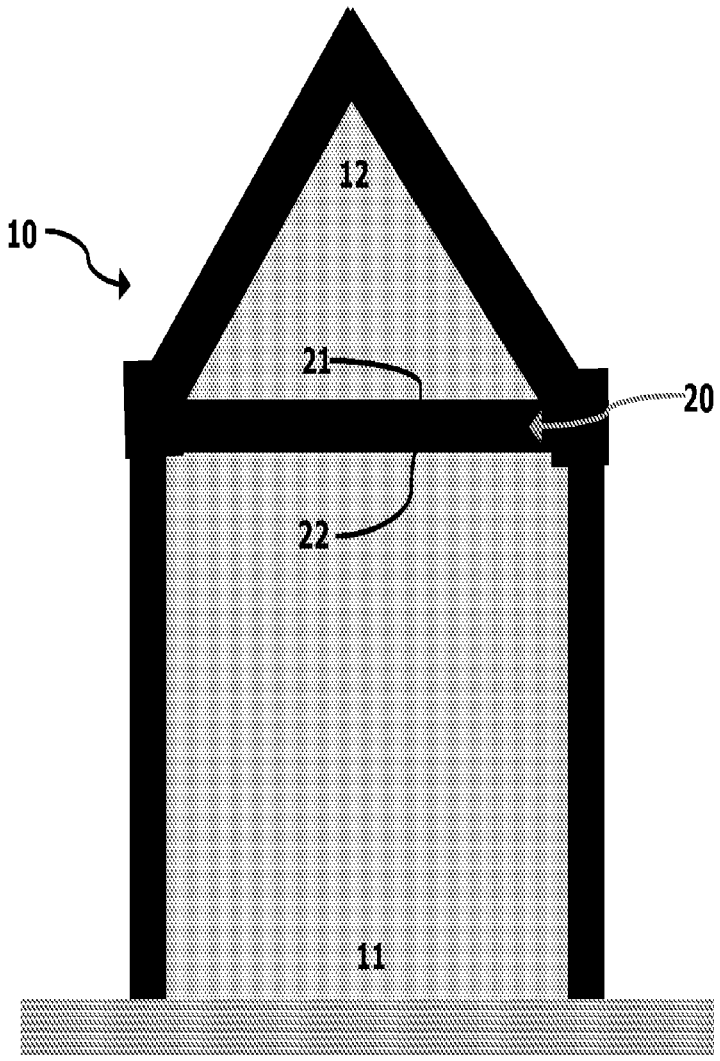
Figure 2A:
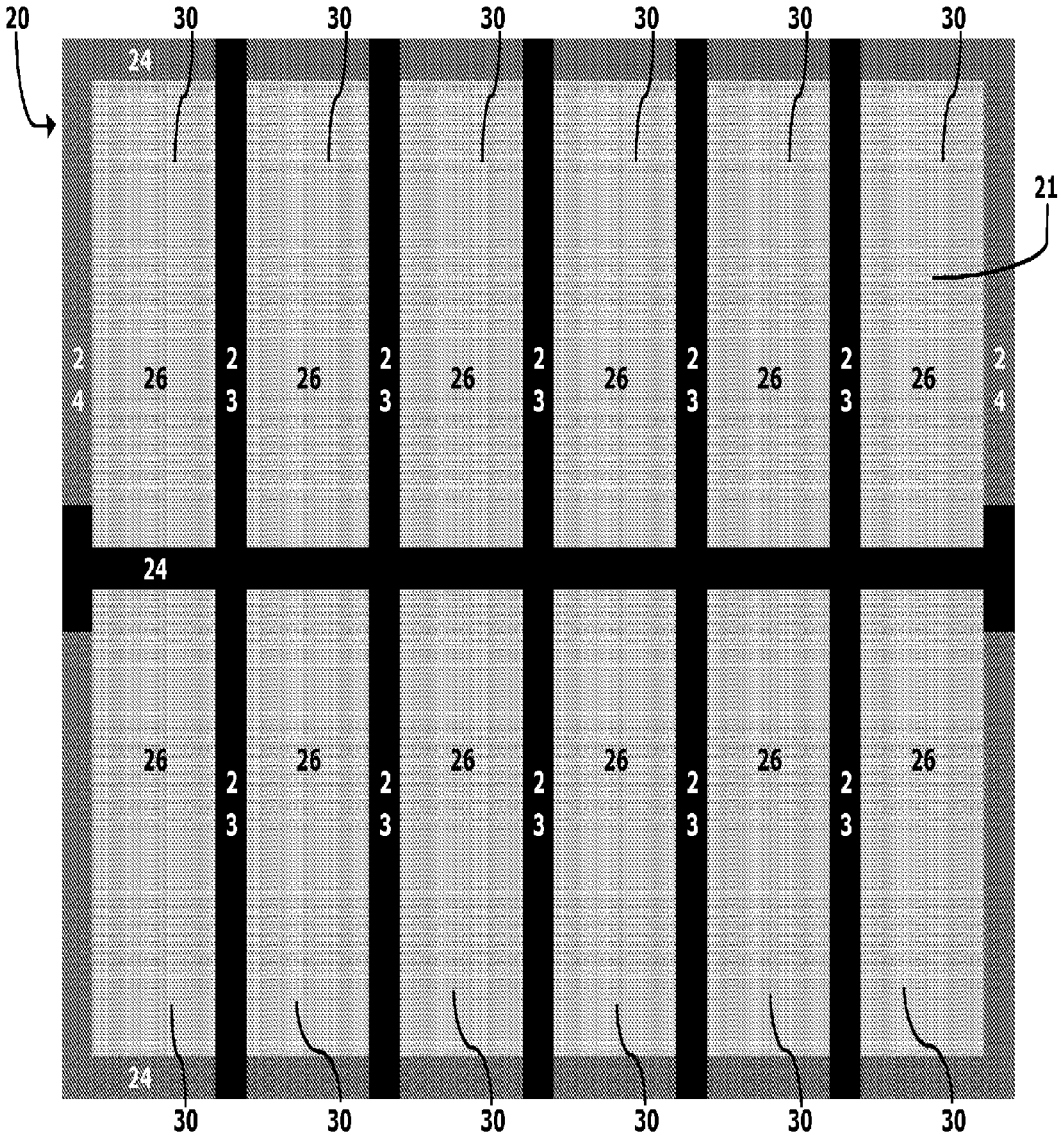
Figure 2B:
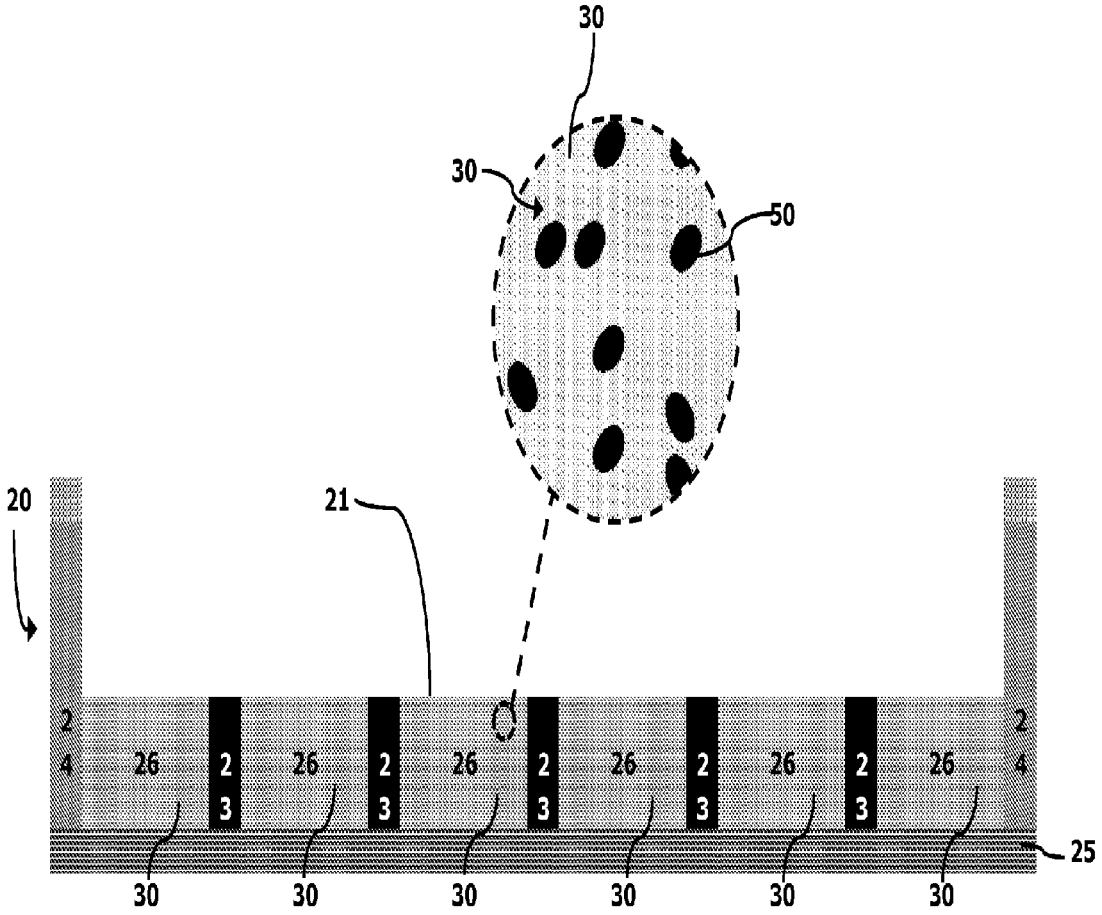
Figure 2C:
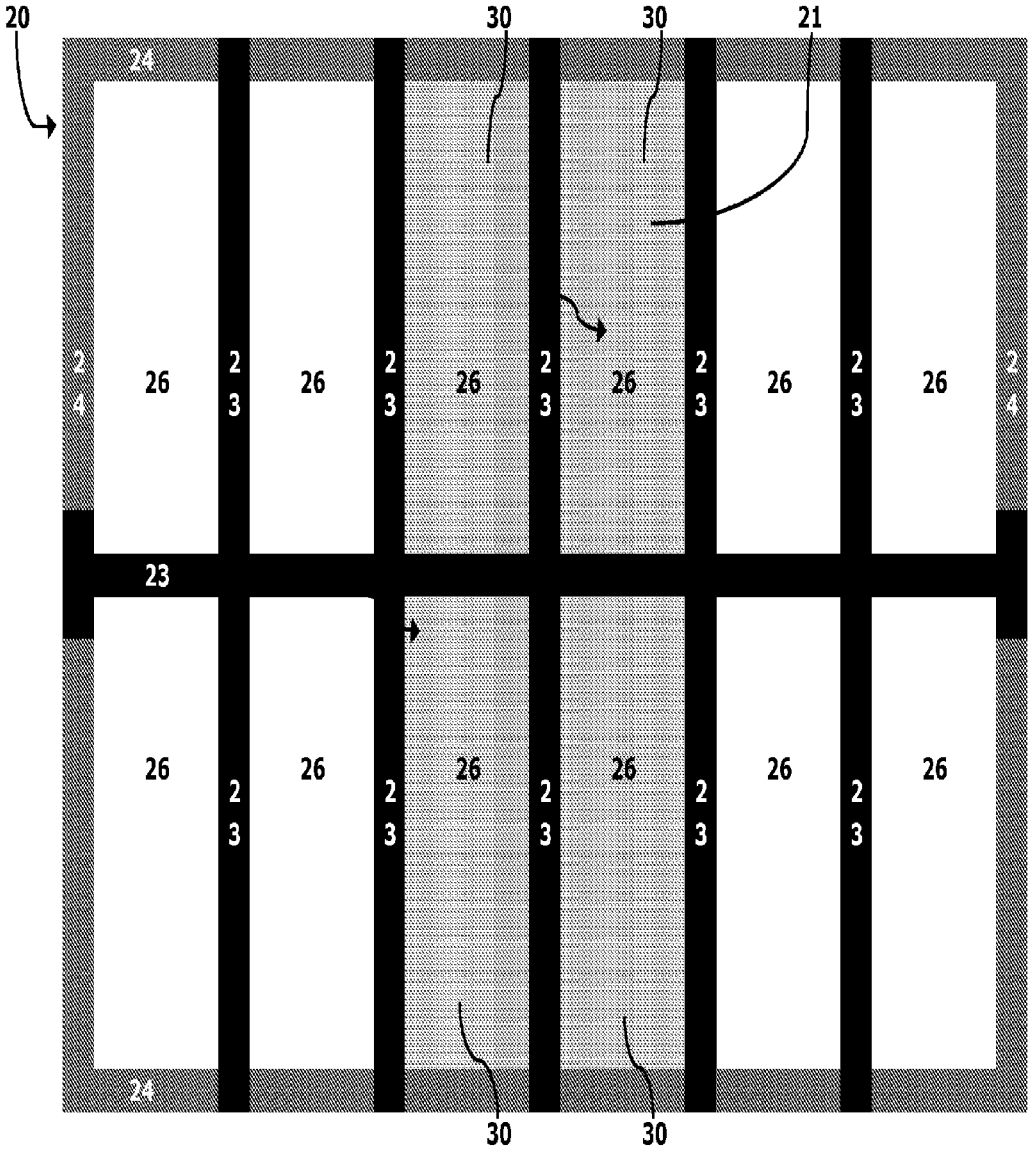
Figure 2D:
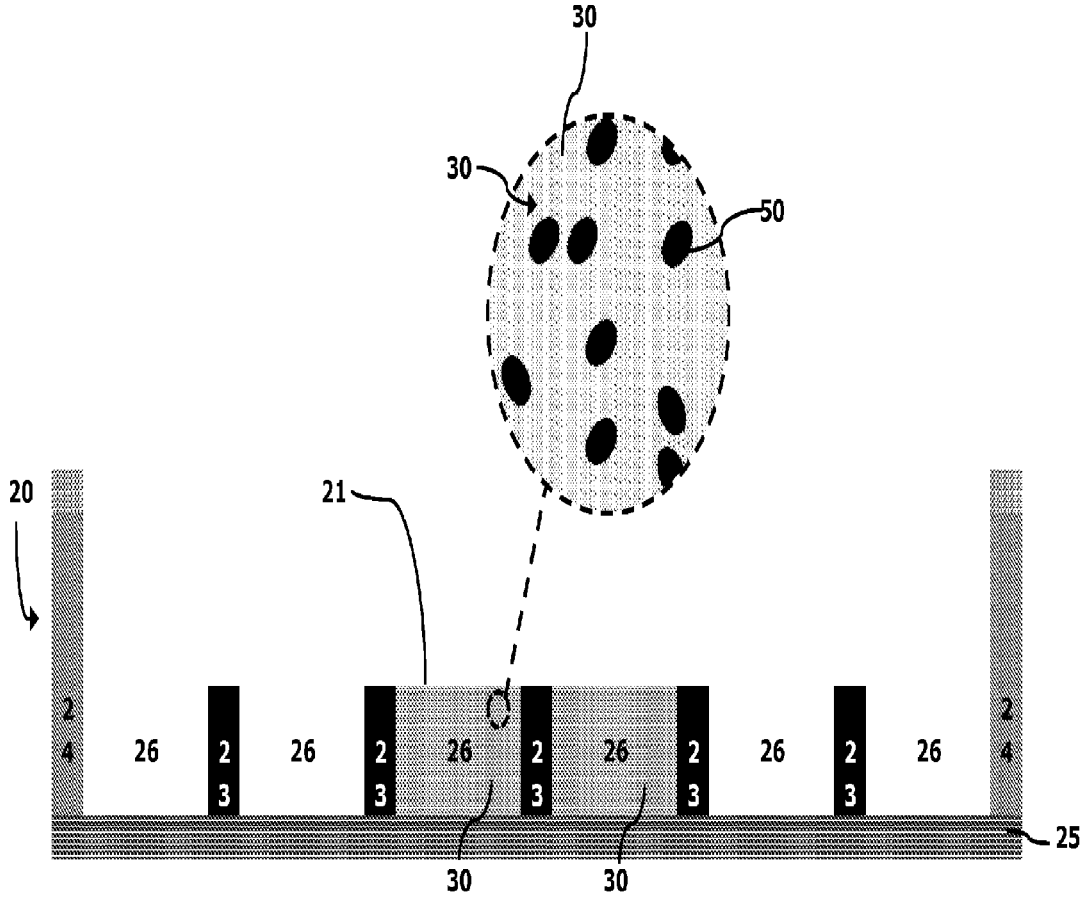
Figure 2E:
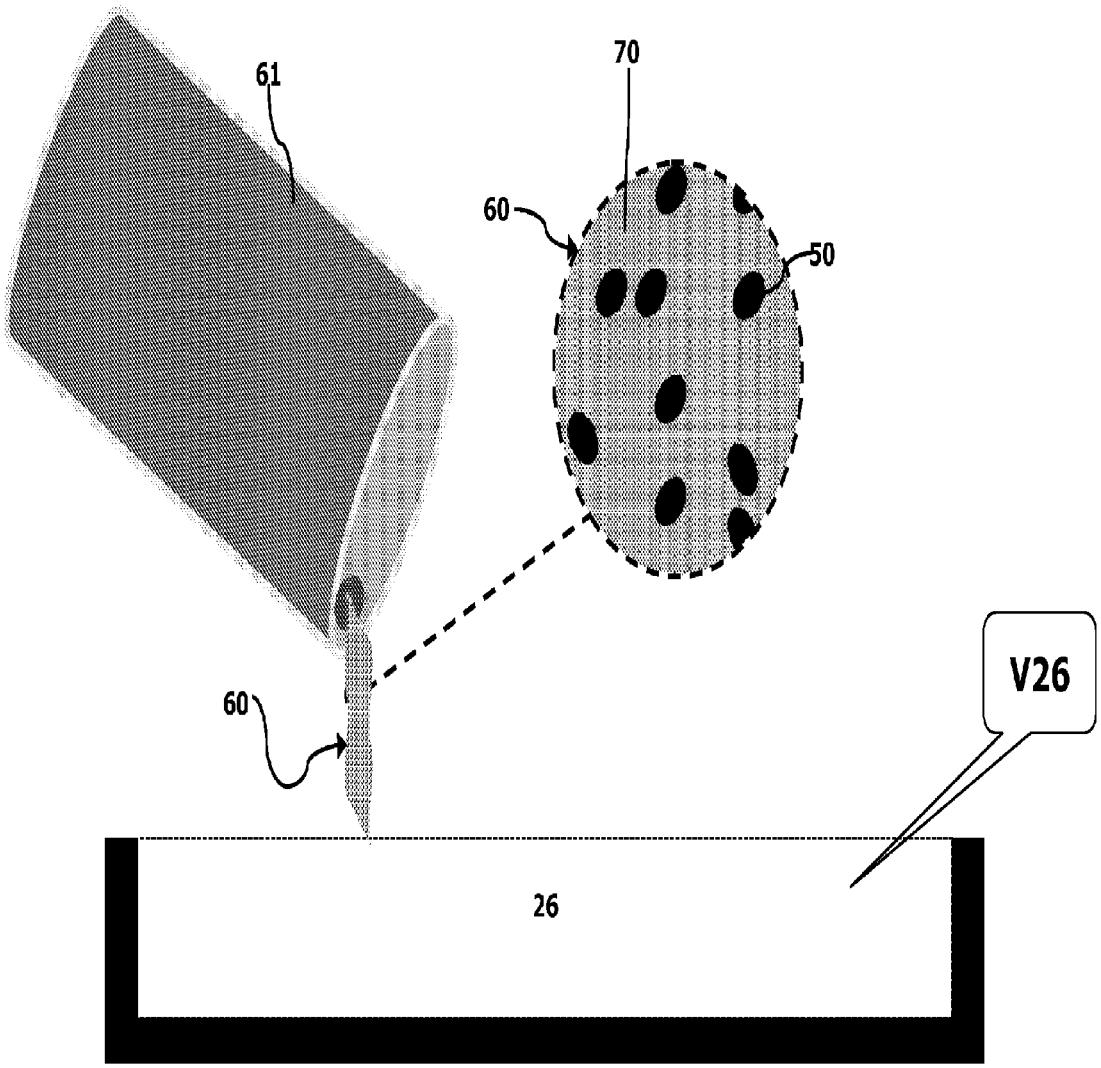
Figure 2F:
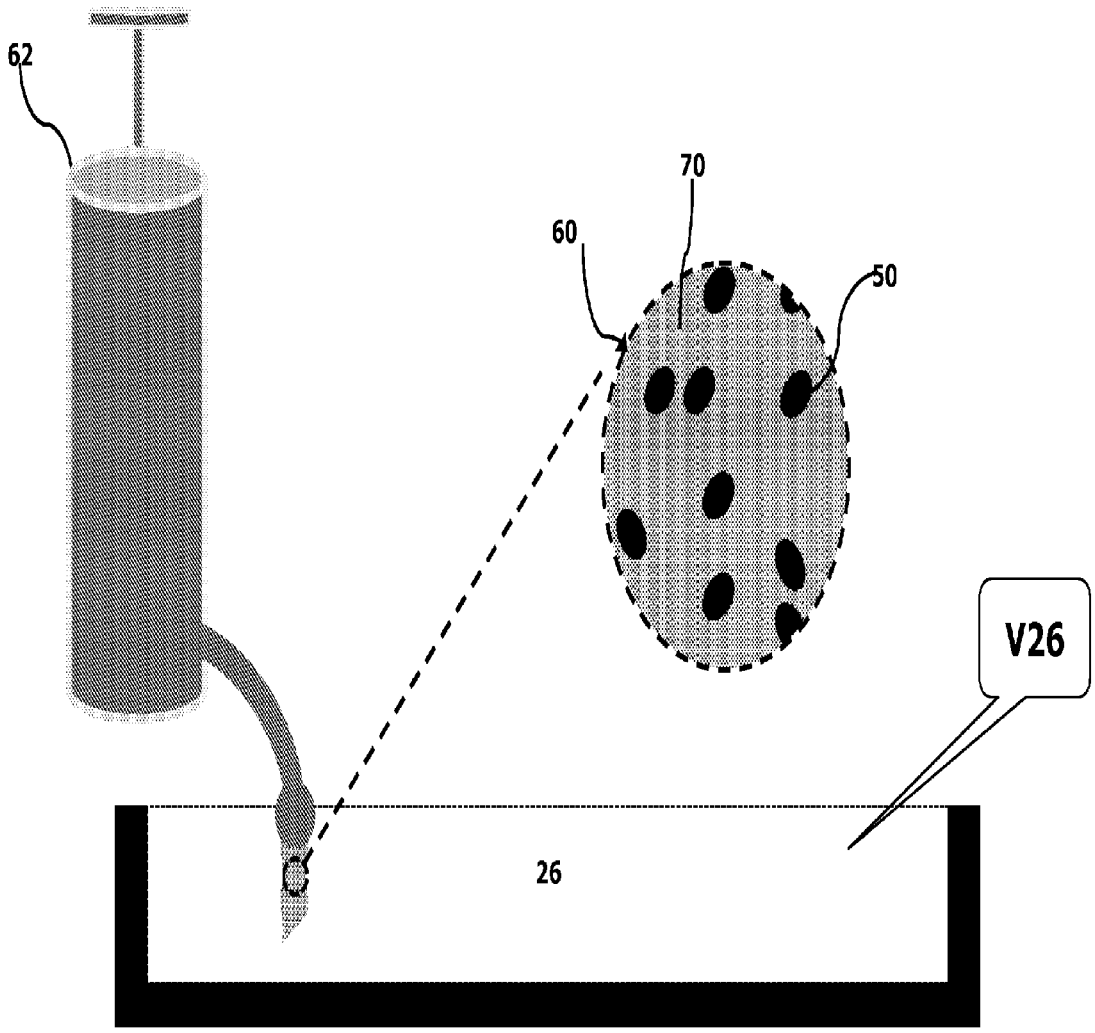
Figure 2G:
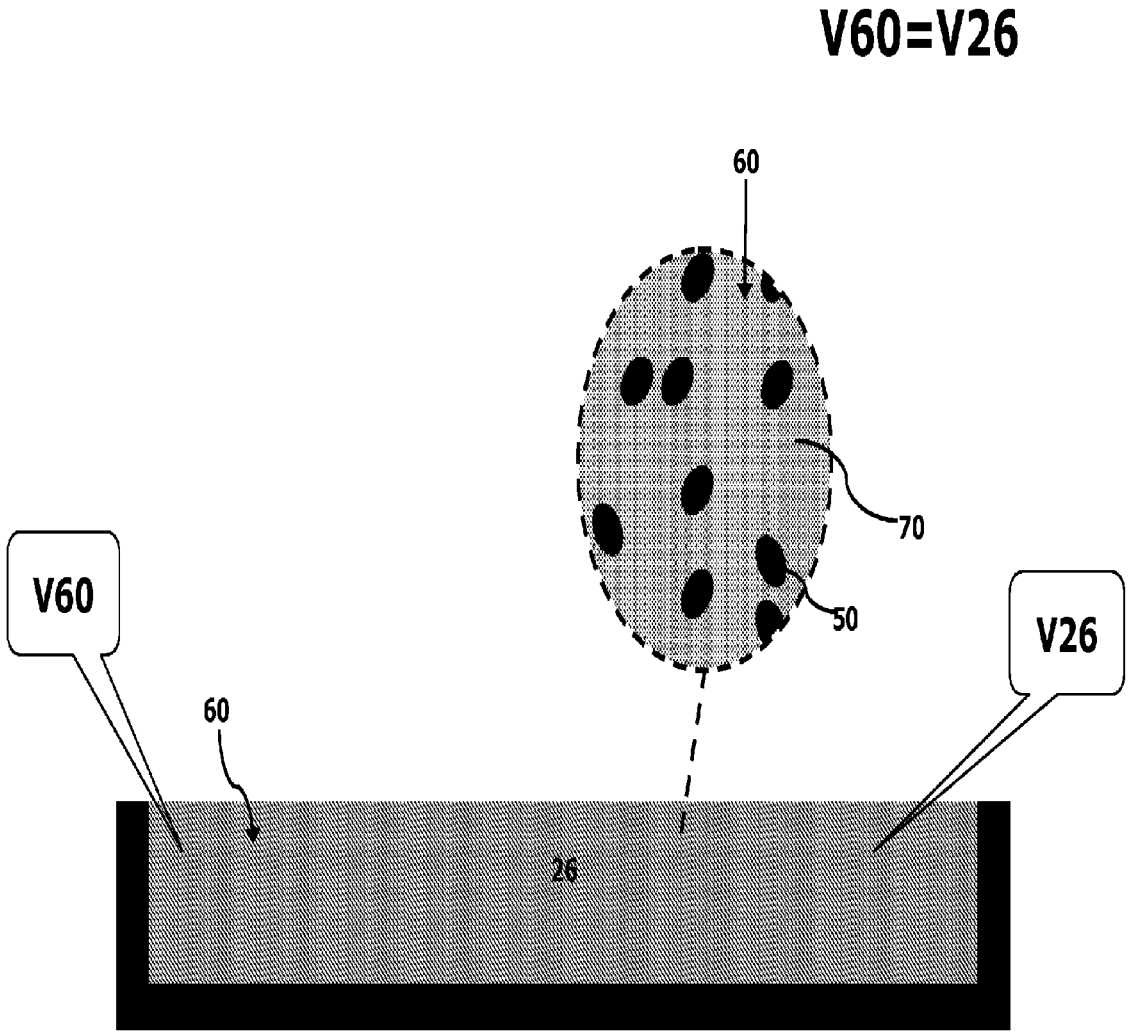
Figure 2H:
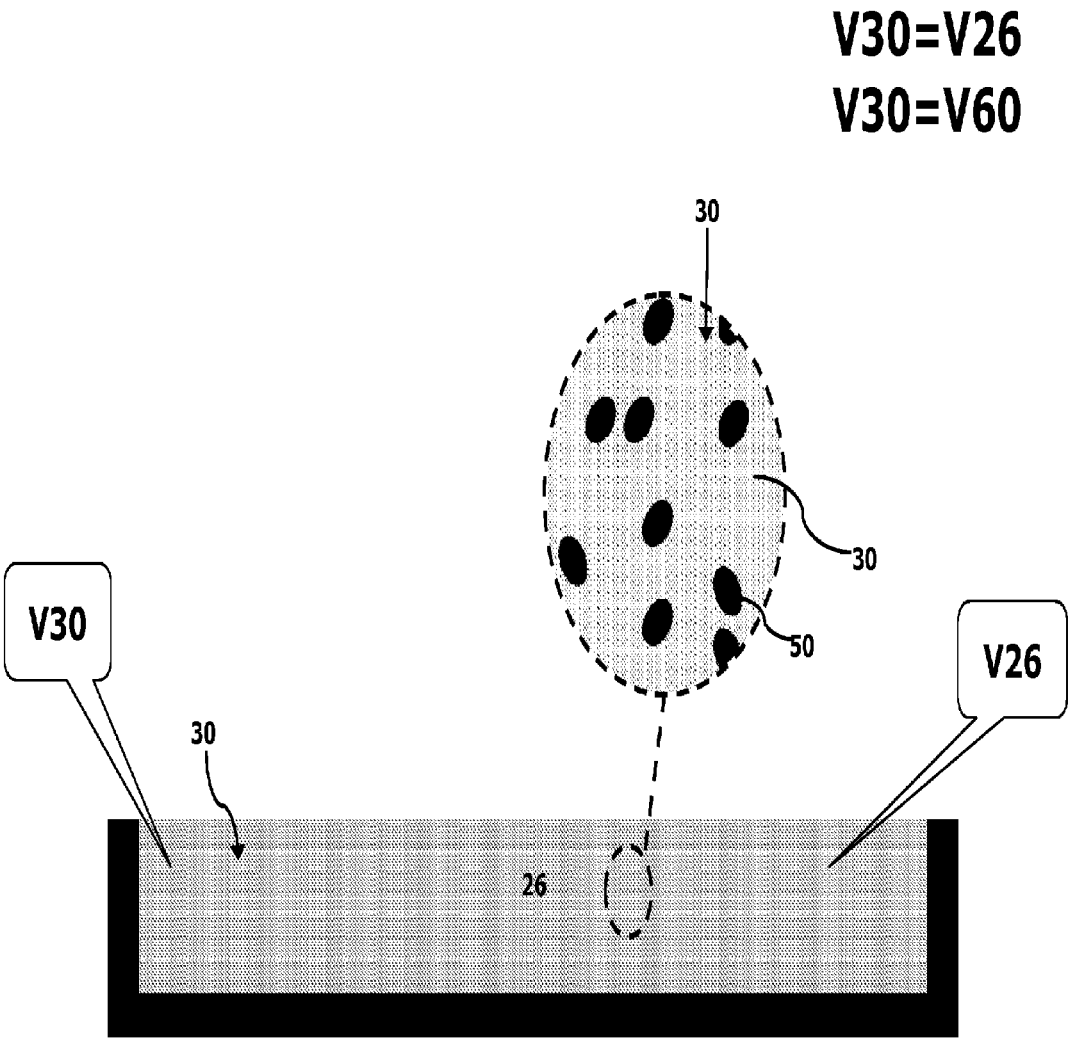
Figure 2I:
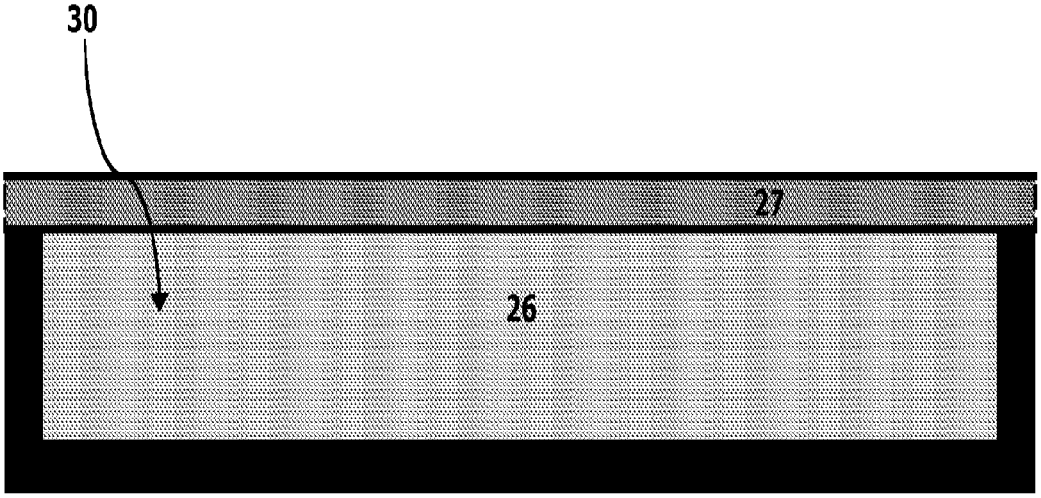
Figure 2J:
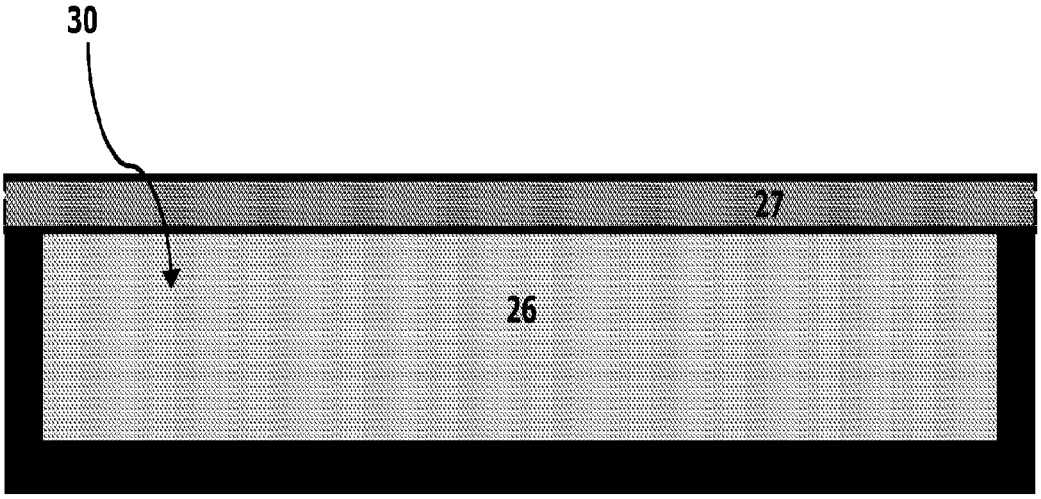
Figure 3A:
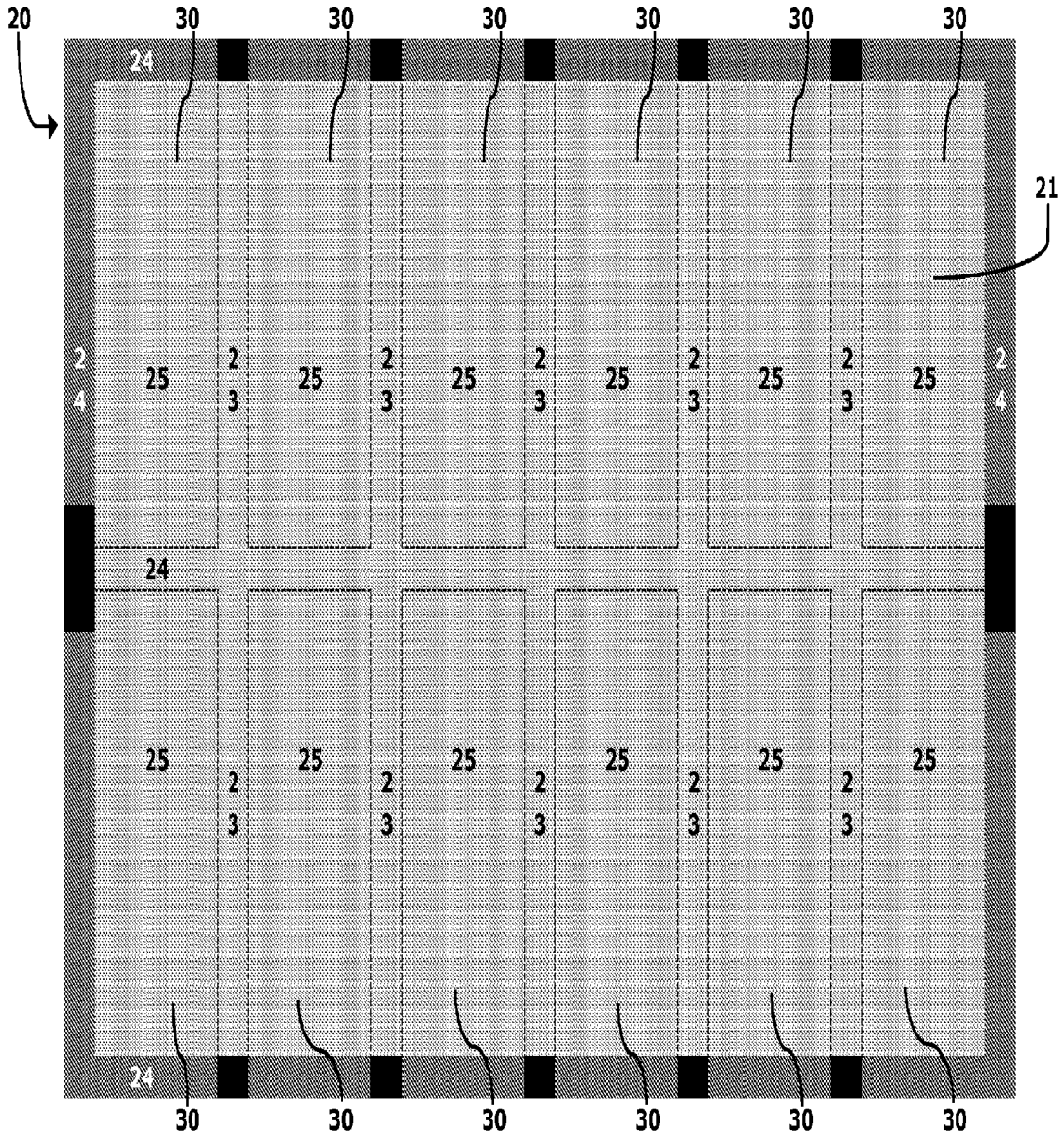
Figure 3B:
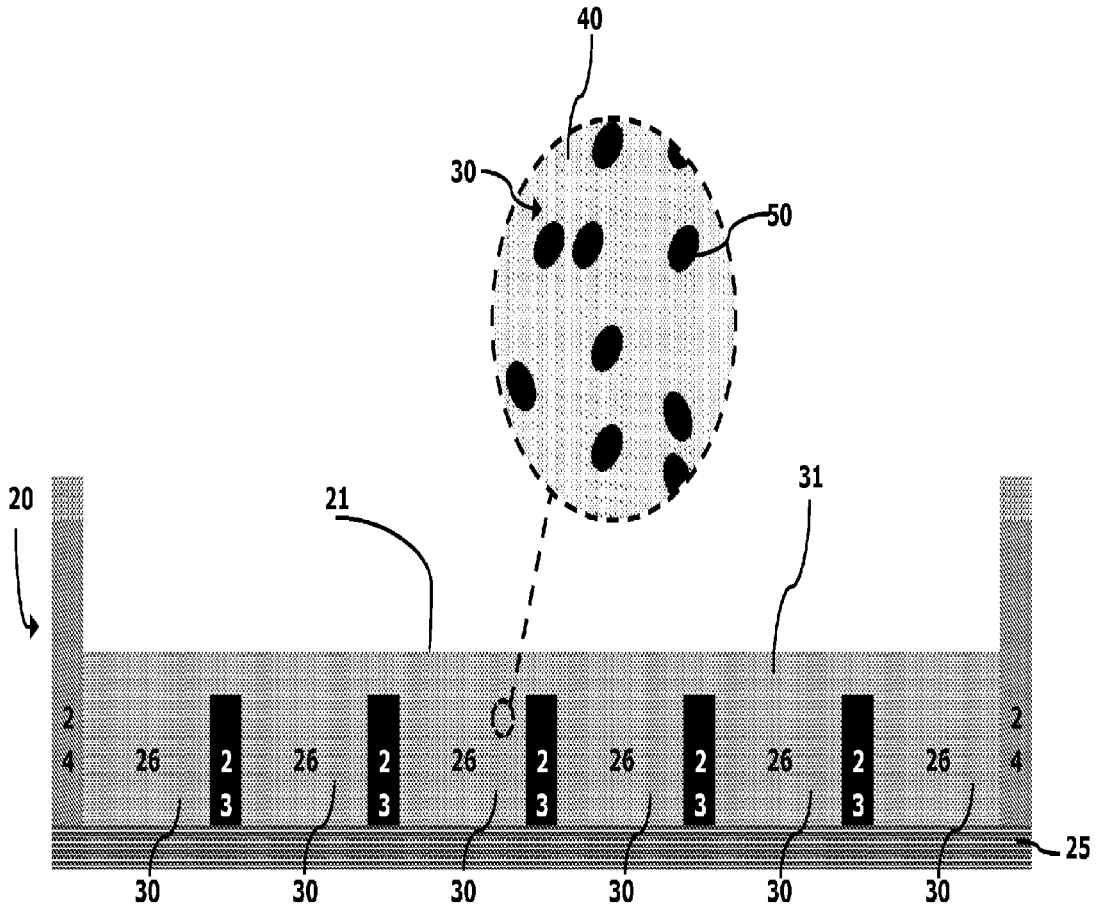
Figure 3C:
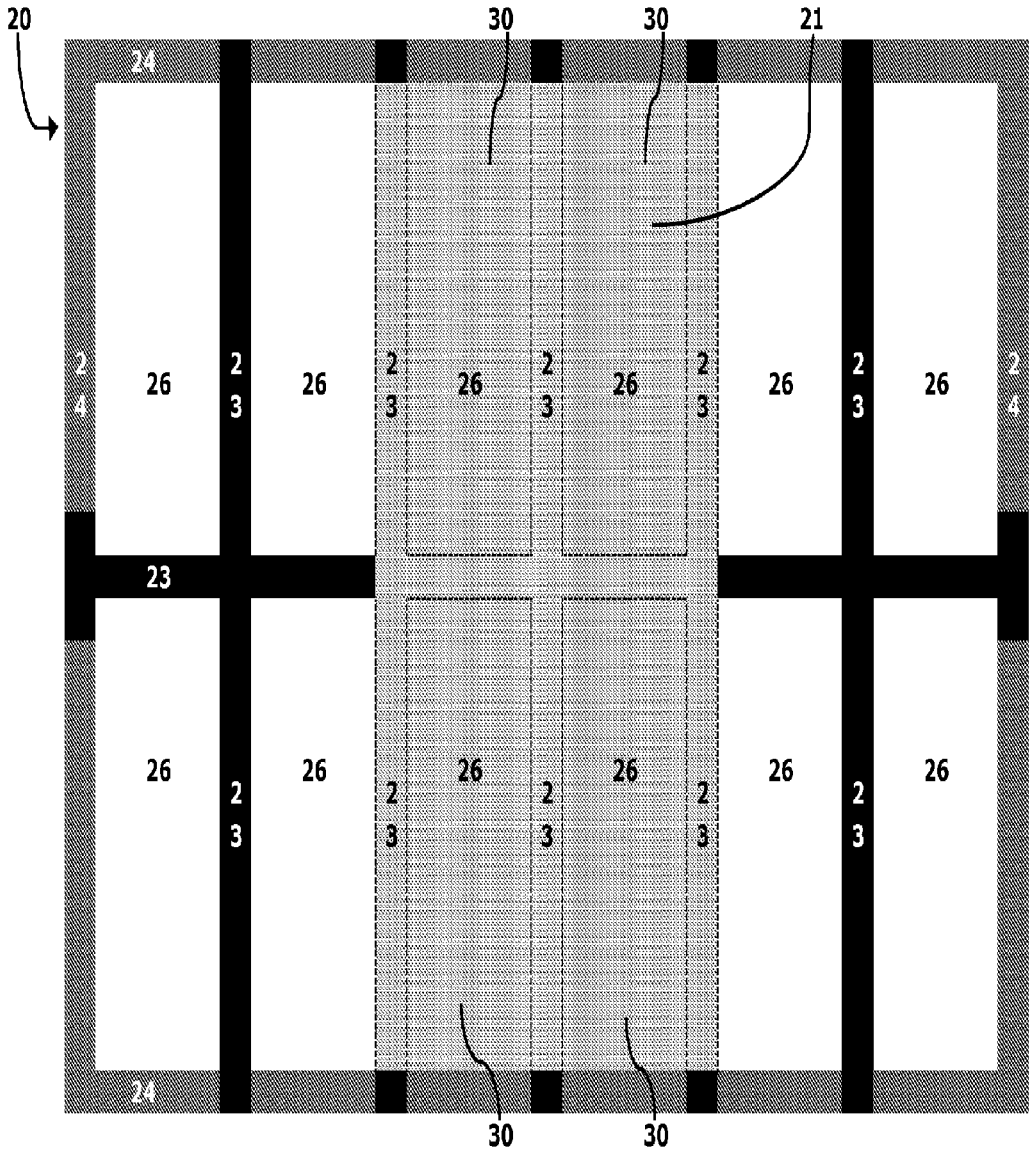
Figure 3D:
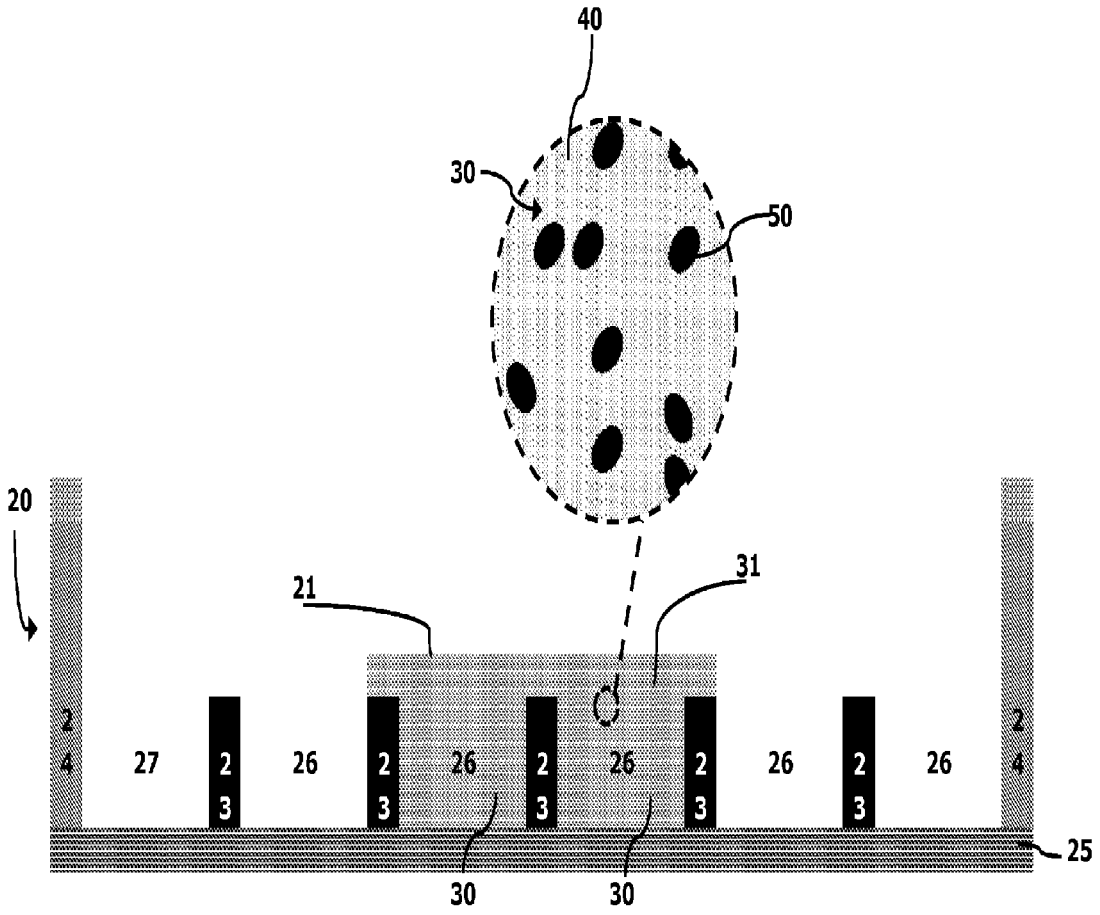
Figure 3E:
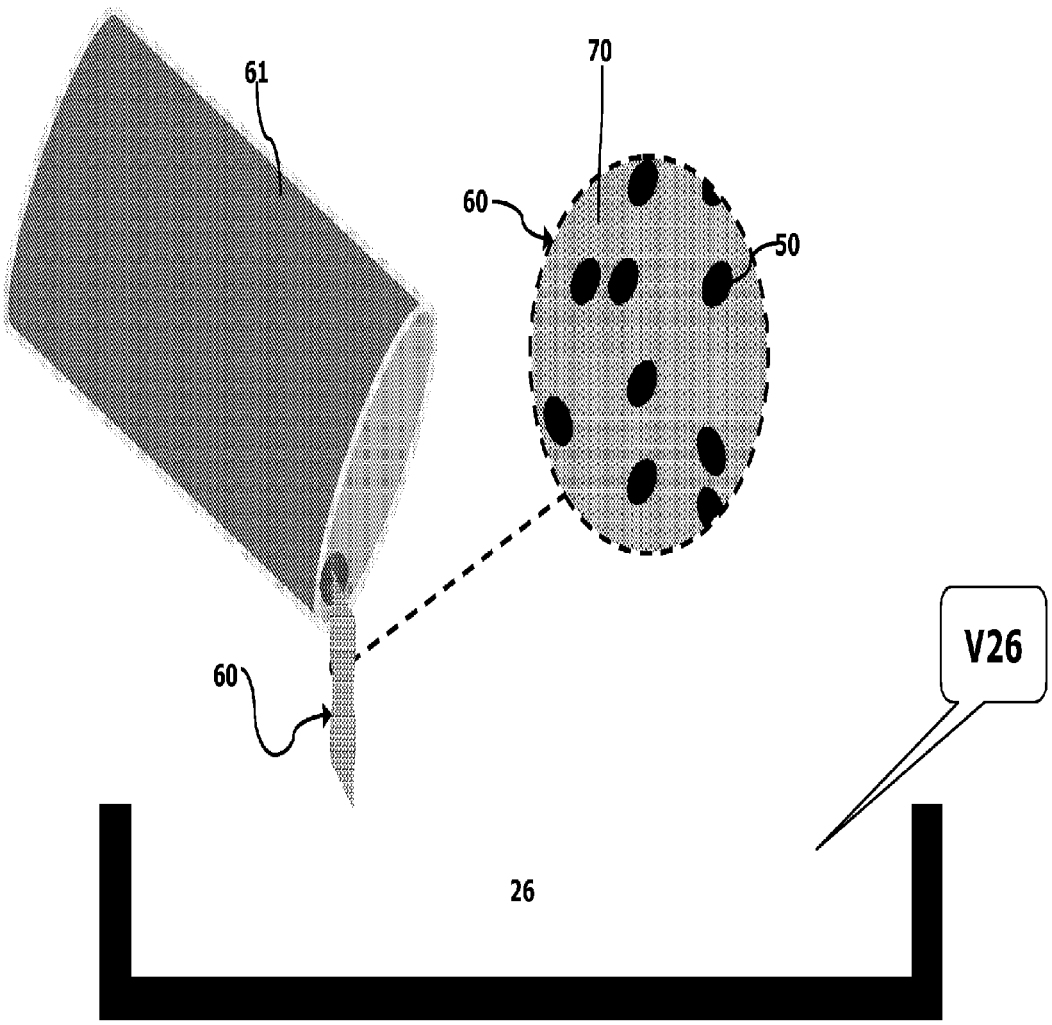
Figure 3F:
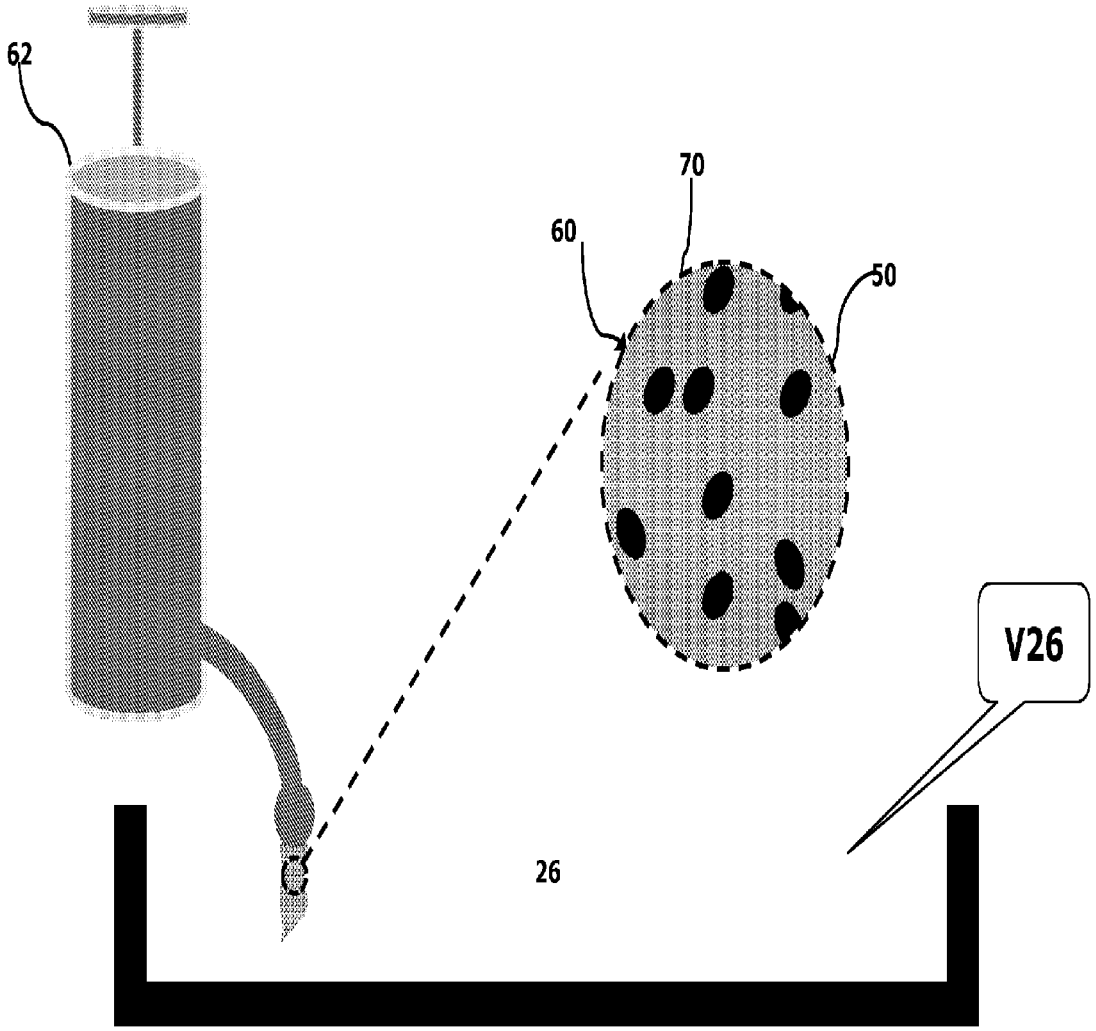
Figure 3G:
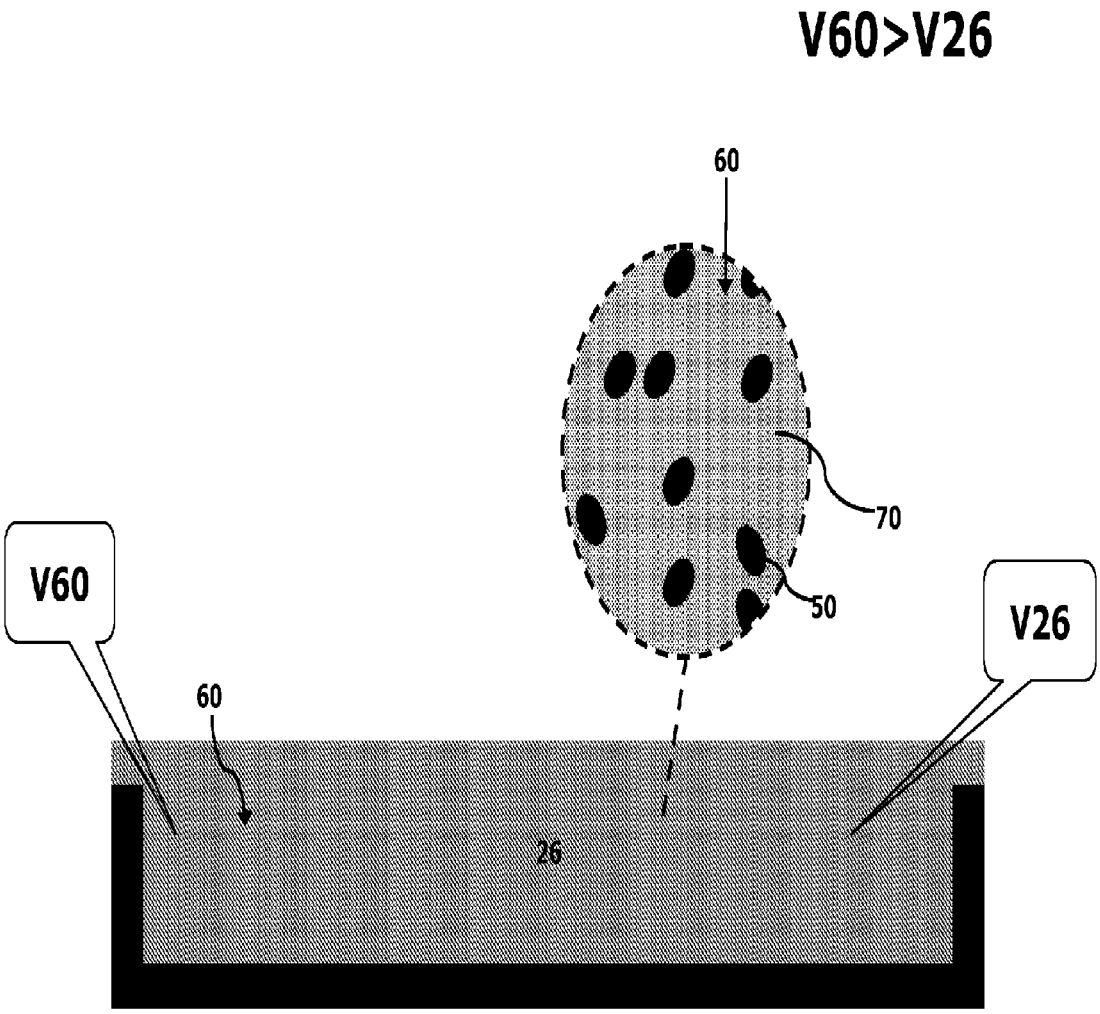
Figure 3H:
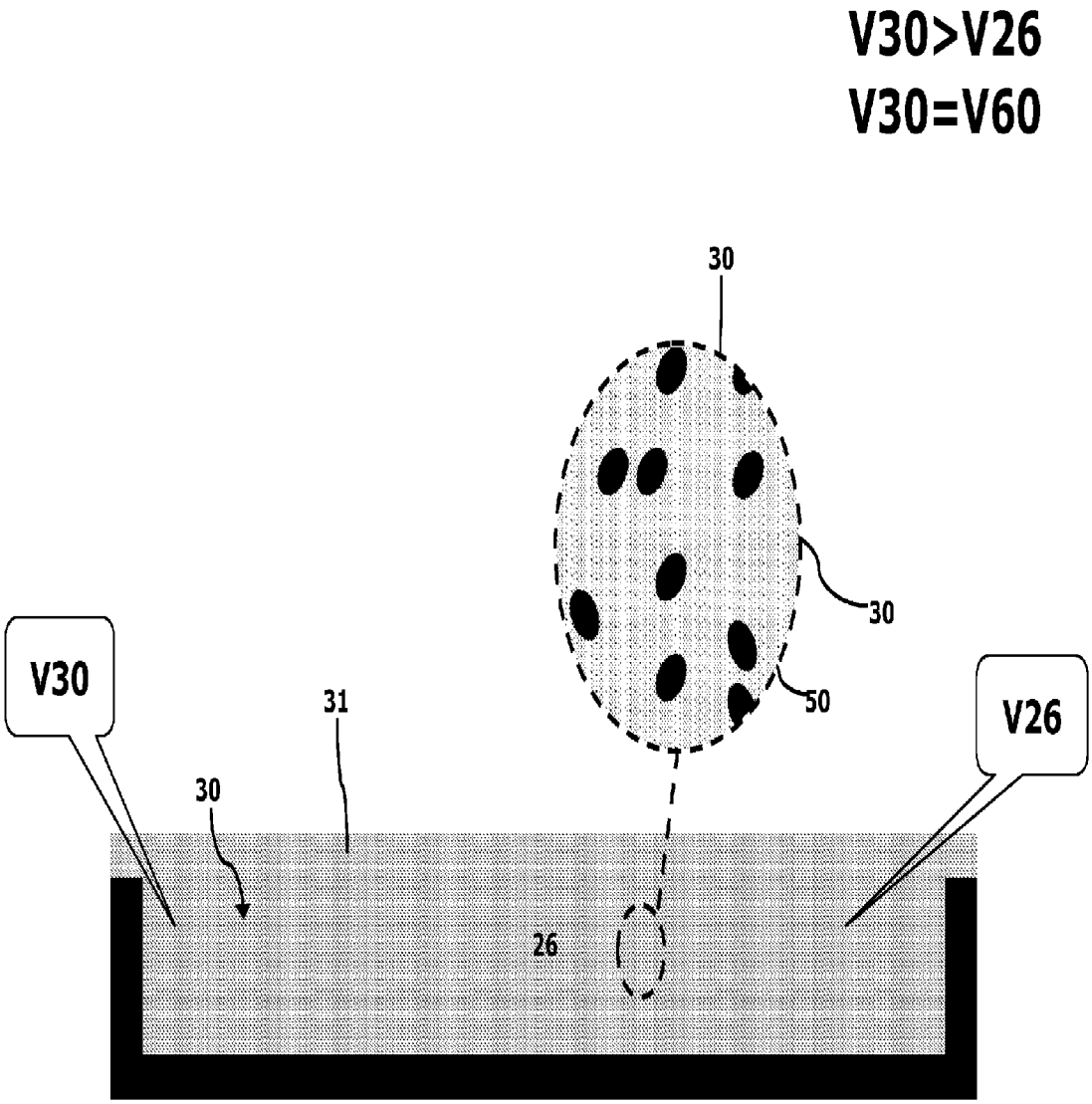
Figure 3I:
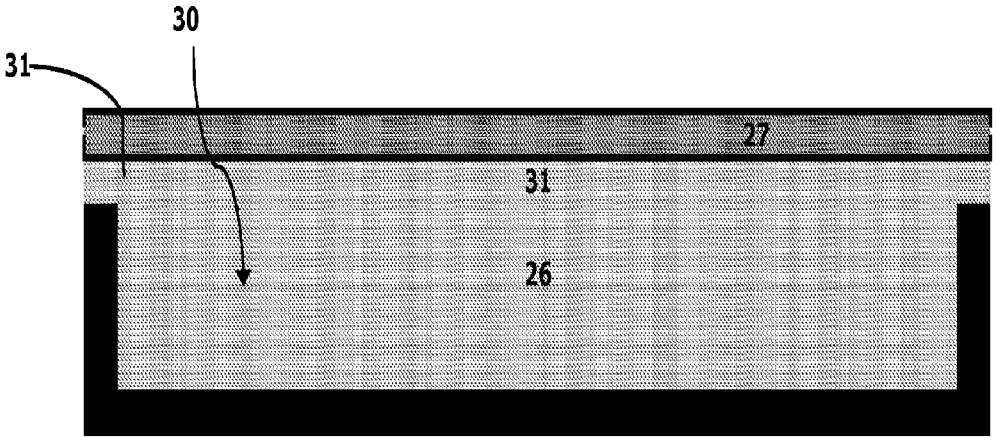
Figure 3J:
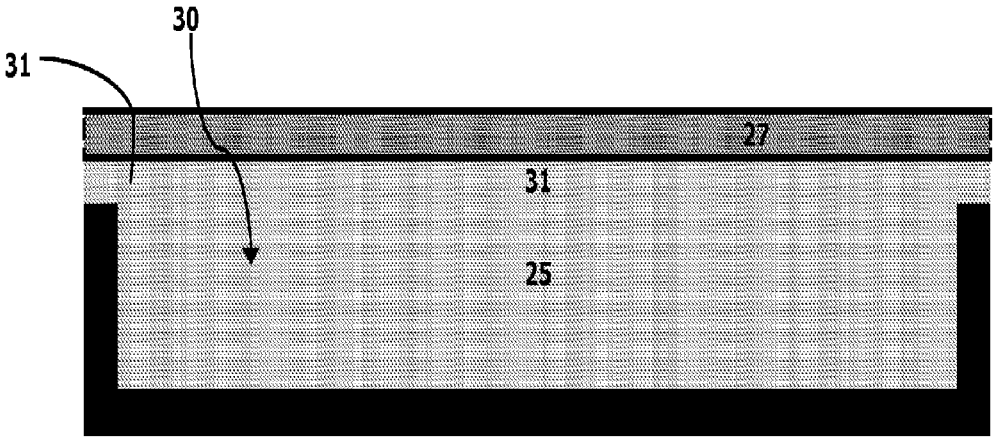

The application is illustrated by way of example and not limitation in the figures of the accompanying drawings, in which like references generally indicate similar elements and in which:

FIG. 1 shows a building having an attic floor assembly.

FIGS. 2A-2J, 3A-3J, 4A-4L, and 5A-5J show some feasible floor-assembly arrangements and associated pod-making steps.

FIGS. 6A-6L, 7A-7L, 8A-8L, and 9A-9L show some possible pod constitutions and corresponding pod-making materials.

DESCRIPTION

Referring now to the drawings, and initially to FIG. 1, a building 10 is shown which includes a lower area 11 and an upper attic area 12. A floor assembly 20 provides a walkable surface 21 in the attic 12 and an insulating interface 22 below the walkable surface 21. The walkable surface 21 has a load-supporting capacity of at 80 psf, at least 100 psf, at least 200 psf, at least 300 psf, and/or at least 400 psf. The insulating interface 22 has an R value of at least 2.0 (a RSI value of at least 0.30) and/or a STC value of at least 30.

Some feasible floor-assembly arrangements are shown in the $2^{nd}$ through $5^{th}$ drawing sets. With particular reference to the first, four figures in each set (FIGS. 2A-2D, 3A-3D, 4A-4D, 5A-5D), each assembly 20 includes members which structurally support the floor. These structural members can include, for example, joist members 23 and joist-bearing members 24.

The joist-bearing members 24 can comprise beams, girders, and/or walls which are positioned perpendicular to the joist members 23. The span between joist-bearing members 24 can be about 4 to about 20 feet long (about 1 to about 8 meters long).

The illustrated floor assemblies 20 also each include a deck member 25. This member 25 may or may not contribute to the structural integrity of the floor assembly 20. In some instances, it may form part of the ceiling of the lower living area 11.

The joist members 23, the joist-bearing members 24, and the deck member 25 form a grid of rectangular cavities 26. The cavity dimensions correspond to joist depth, spacing, and span. Accordingly, each cavity 26 can be, for example, about 4 to about 16 inches deep (about 10 to about 40 centimeters deep), about 10 to about 30 inches wide (about 26 to about 80 centimeters wide), and about 4 to about 20 feet long (about 1 to about 8 meters long).

Each floor assembly 20 comprises pods 30 which occupy at least some of the cavities 26. Each pod 30 comprises a solidified carrier 40 and pellets 50 dispersed and embedded therein. The pods 30 adopt the cavities' shape whereby they resemble rectangular blocks in the illustrated embodiments.

In the floor assembly 20 shown in the $2^{nd}$ drawing set, the tops of the pods 30 and the tops of the joists form the flat walkable surface 21. In the floor assembly 20 shown in the $3^{rd}$ drawing set, pod-integral stratums 31 are situated above the cavities and the stratum tops form the walkable surface 21. In the $4^{th}$ and $5^{th}$ drawing sets, a cover sheet 27 over the pods 30 forms the walkable surface 21. The sheet 27 can be continuous (e.g., plywood, linoleum, laminate, oriented strand board, carpeting, etc.) as shown in the $4^{th}$ drawing set, or it can be segmented (e.g., hardwood strips, tiles, etc.) as shown in the $5^{th}$ drawing set. In each case, the pods 30 contribute to the structural integrity of the walkable surface 21.

In the floor assembly 20 shown in the $2^{nd}$ drawing set, lower portions of the pods 30 are contained in the interface 22. In the floor assemblies shown in the $3^{rd}$ through $5^{th}$ drawing sets, the entire pods 30 are included in the interface 22. And in each case, the pods 30 contribute to the insulating ability of the interface 22.

In the initial two figures of each drawing set (FIGS. 2A-2B, 3A-3B, 4A-4B, and 5A-5B), all of the cavities 26 are occupied by pods 30. In this manner, the walkable surface 21 can provide an uninterrupted platform in the attic 12. This approach could be adopted, for example, when the attic 12 is intended to provide additional living or storage space, and/or allow walking access across the pod surface 26.

In the next two figures of each drawing set (FIGS. 2C-2D, 3C-3D, 4C-4D, and 5C-5D), only selected cavities 26 are occupied by pods 30 to form the walkable surface 21. If the pod-occupied cavities 26 are adjacent and/or aligned, they can provide a reinforced area. This approach can be adopted, for example, when only limited access (e.g., to an attic window) is desired and/or when only certain attic areas will be used for storage.

As is best seen by referring to the following figures in each drawing set (FIGS. 2E-2F, 3E-3F, 4E-4G, and 5E-5G), the cavities 26 each define a volume V26. Volumes can and often do vary among cavities 26, but they will typically range between about 1 cubic foot to about 70 cubic feet (about 25 cubic decimeters to about 2600 cubic decimeters).

The open-cavity assemblies 20 shown in the $2^{nd}$ and $3^{rd}$ drawing sets are typical of unfinished attic floors in existing buildings and/or of still-being-assembled floors in ongoing constructions. Such an open-topped grid can also be attained by removing the covering (e.g., a continuous or segmented sheet 27) from a finished floor in an existing building. And after the pods 30 have been created in the cavities 26, they can be lidded (e.g., covered, enclosed, etc.) with a continuous or segmented sheet 27, whereby the floor assembly 20 would resemble those shown in the $4^{th}$ and $5^{th}$ drawing sets.

Figure 4A:
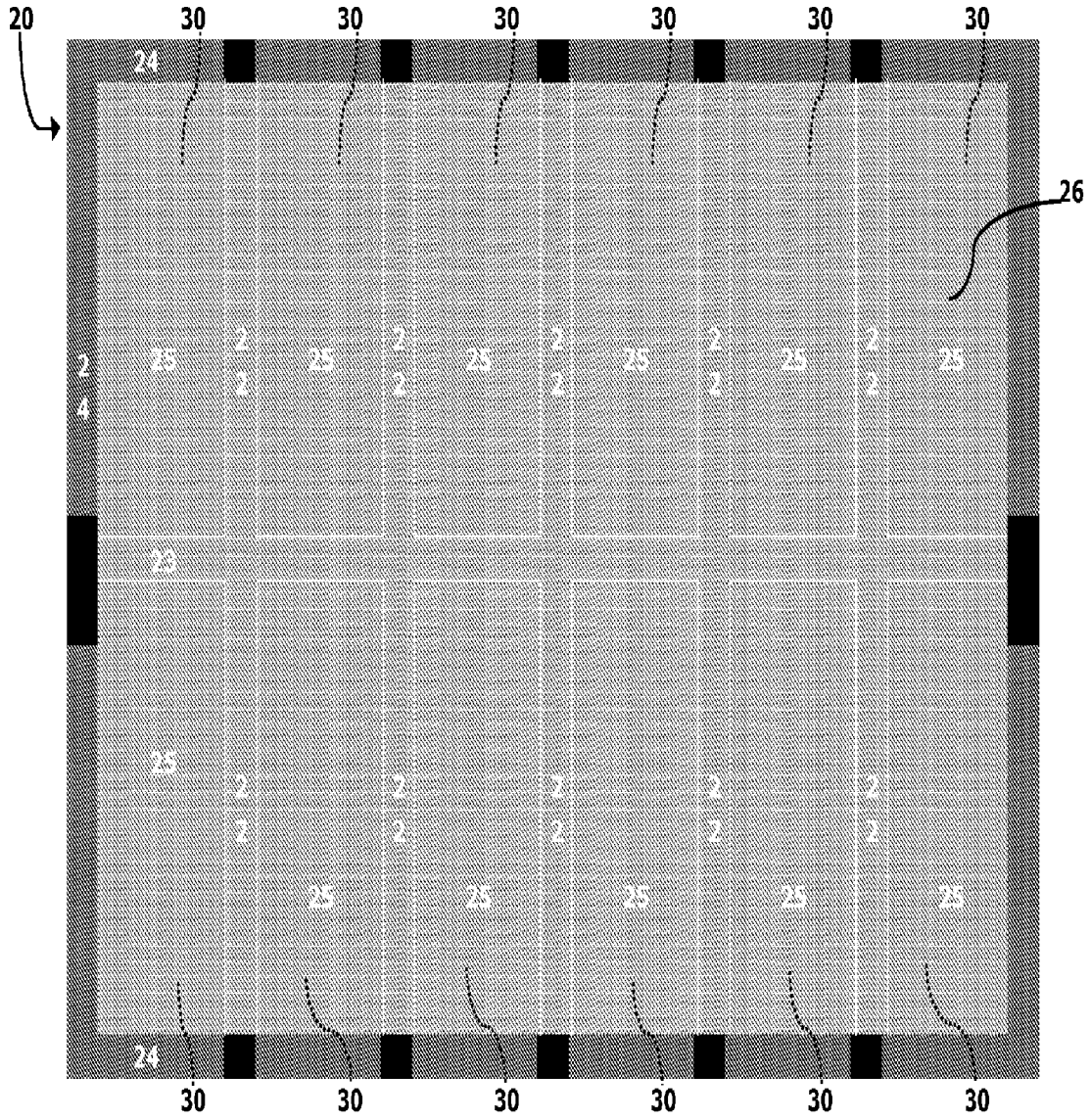
Figure 4B:
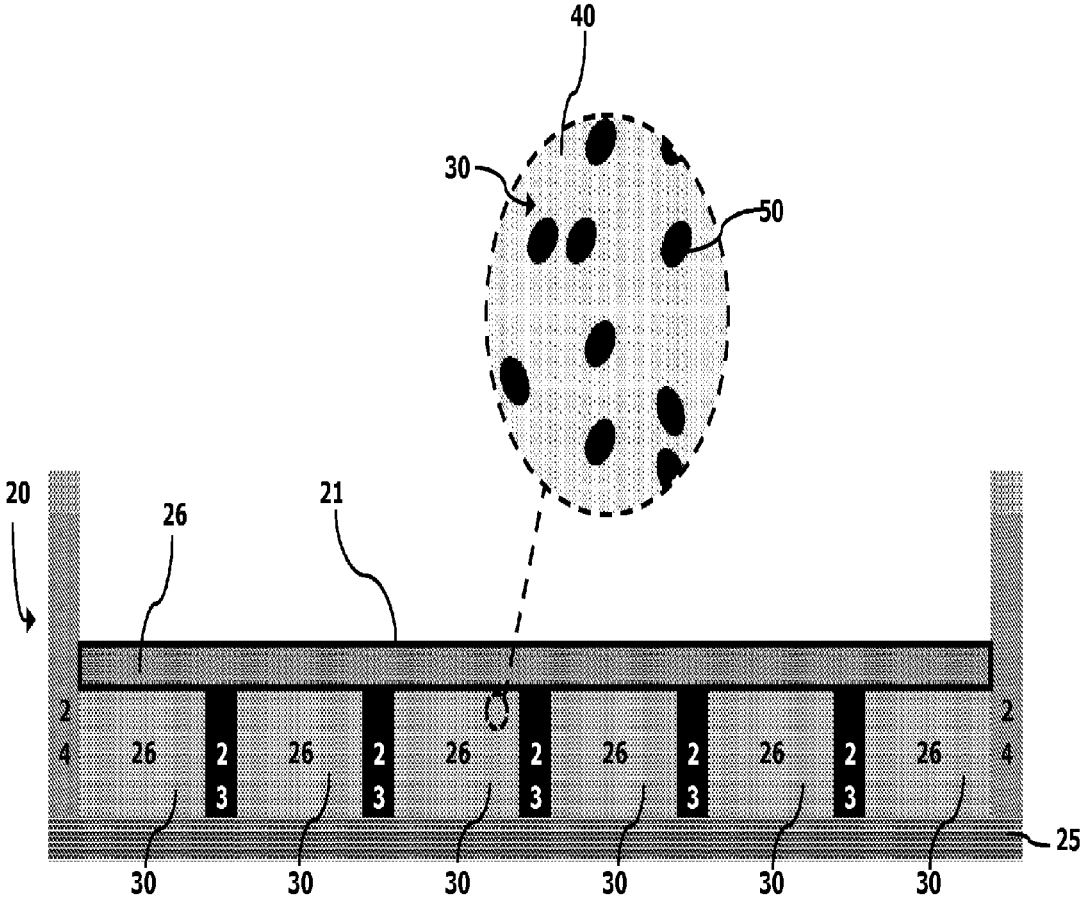
Figure 4C:
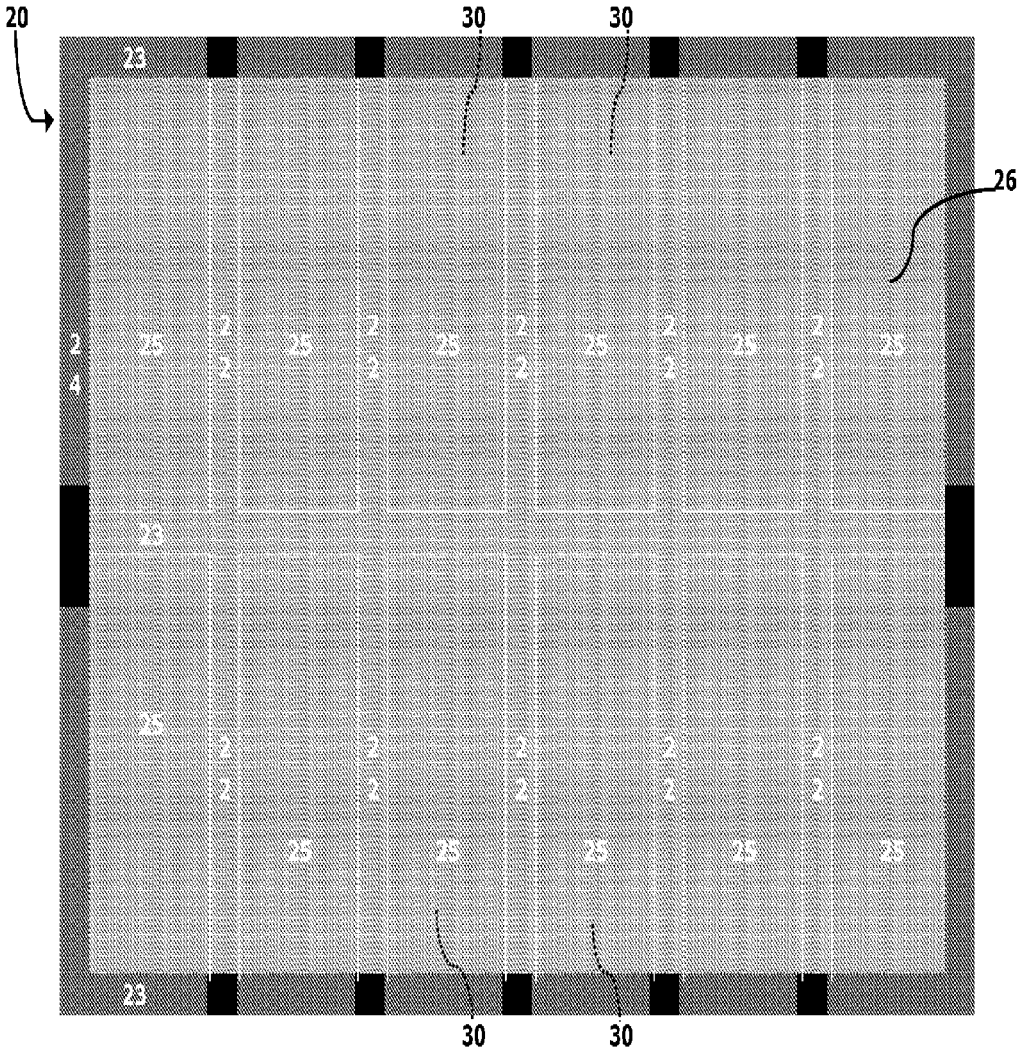
Figure 4D:
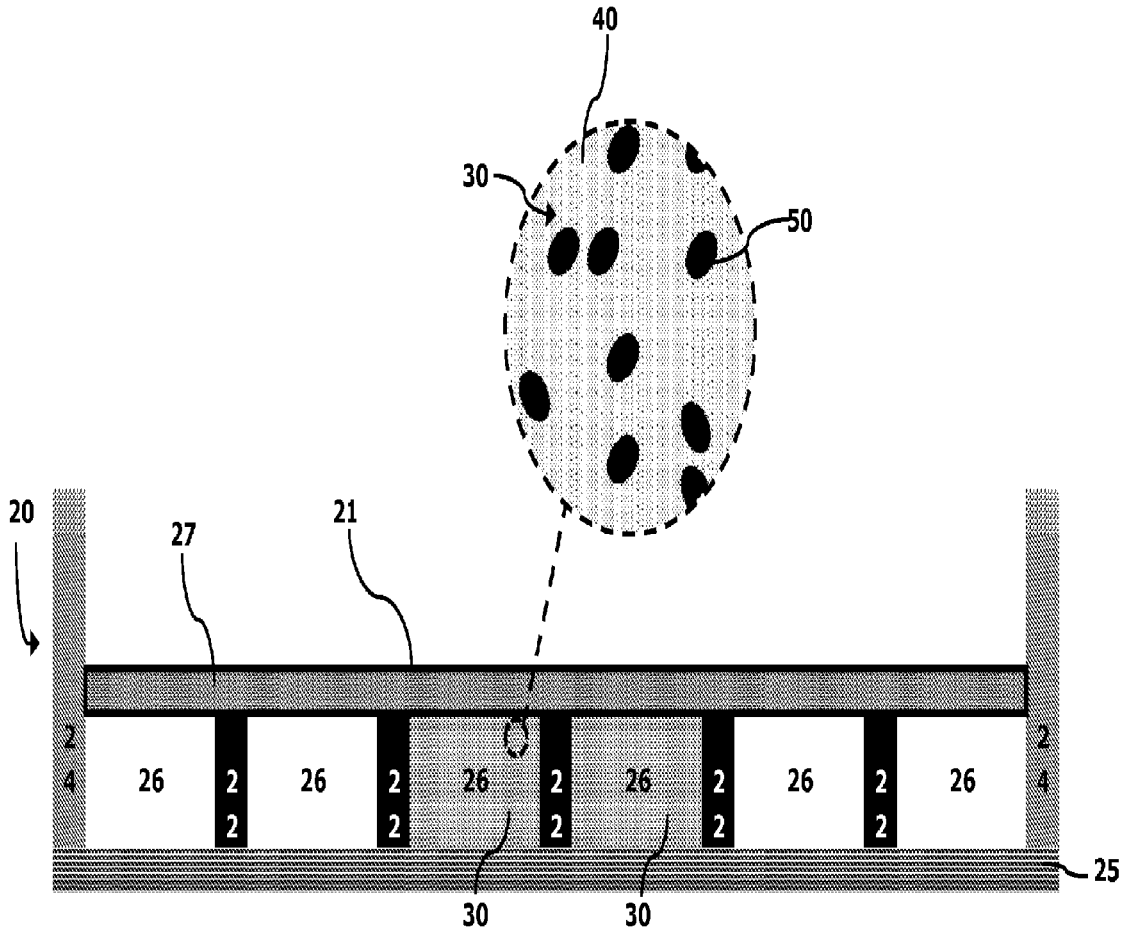
Figure 4E:
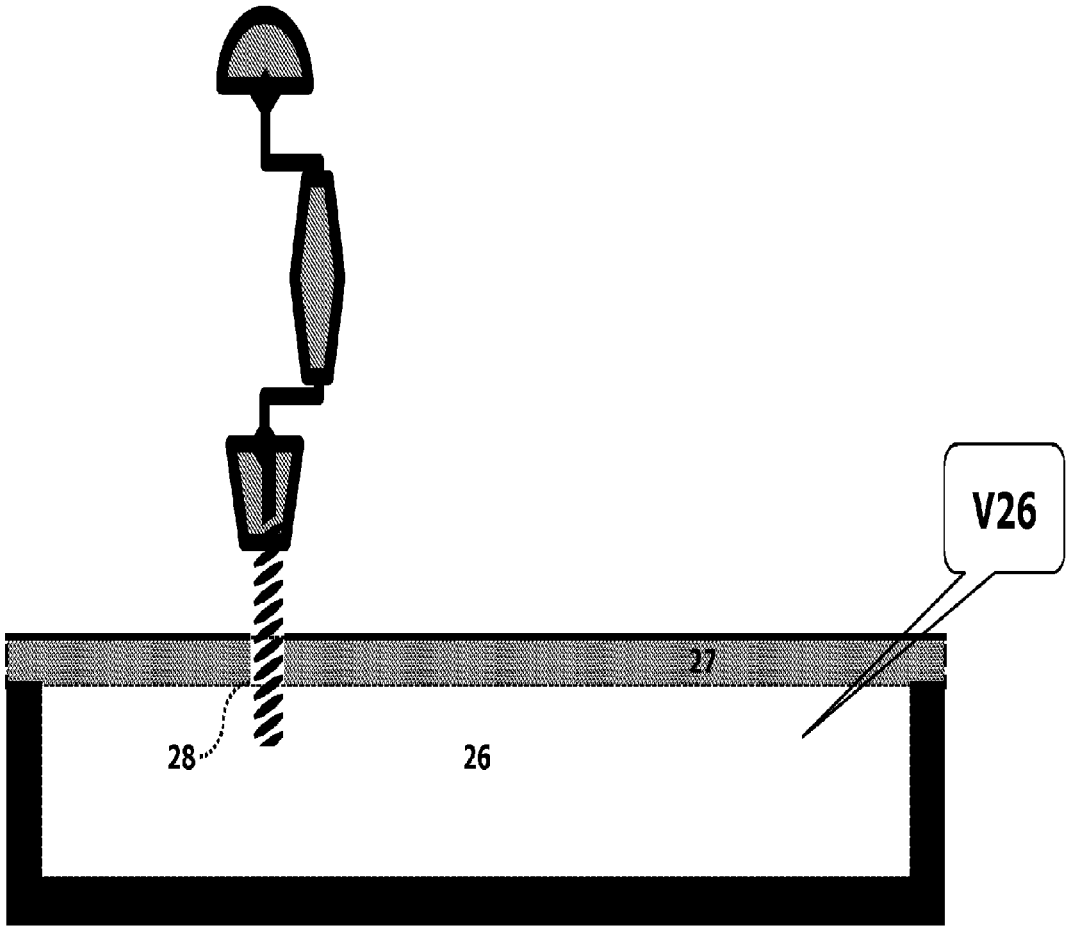
Figure 4F:
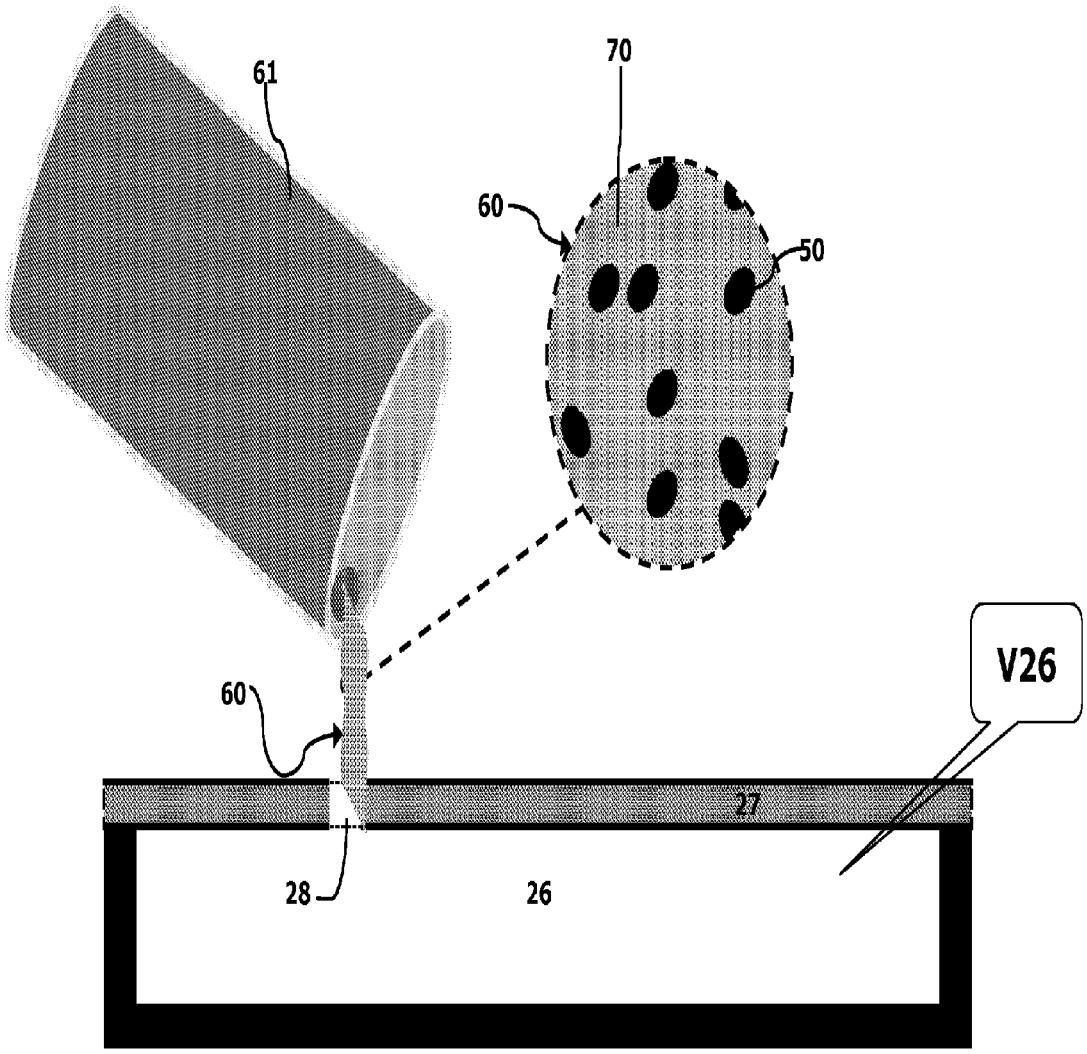
Figure 4G:
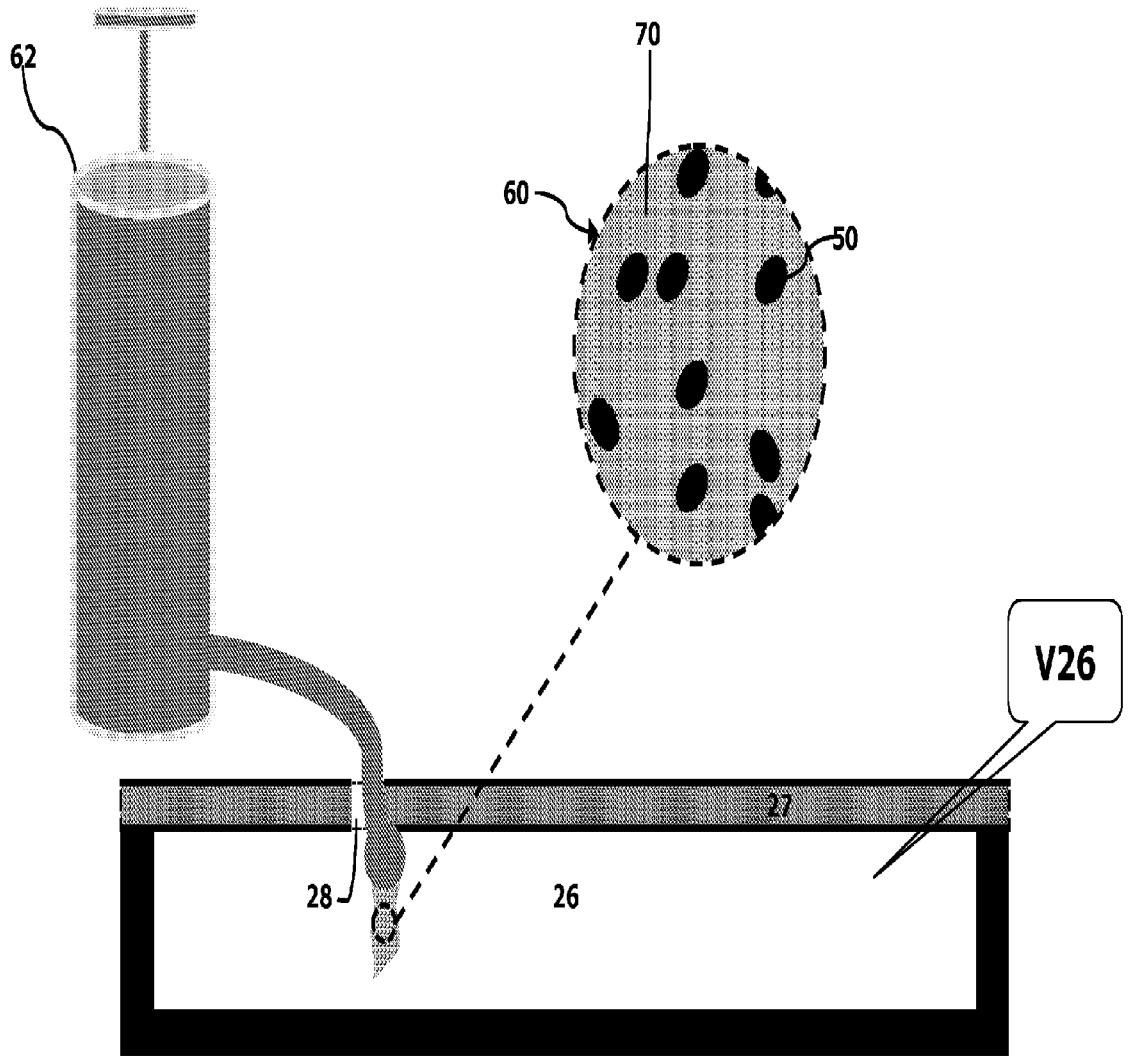
Figure 4H:
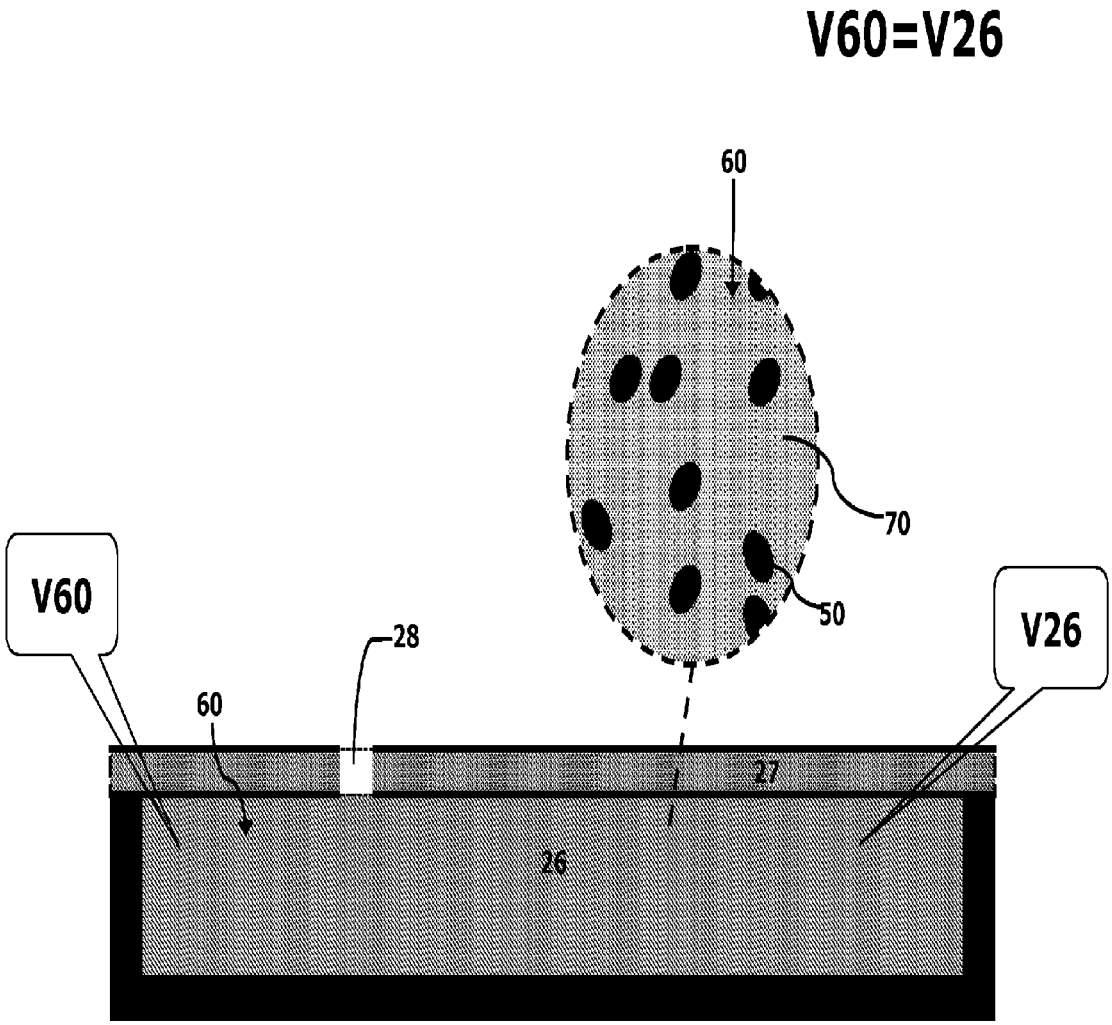
Figure 4I:
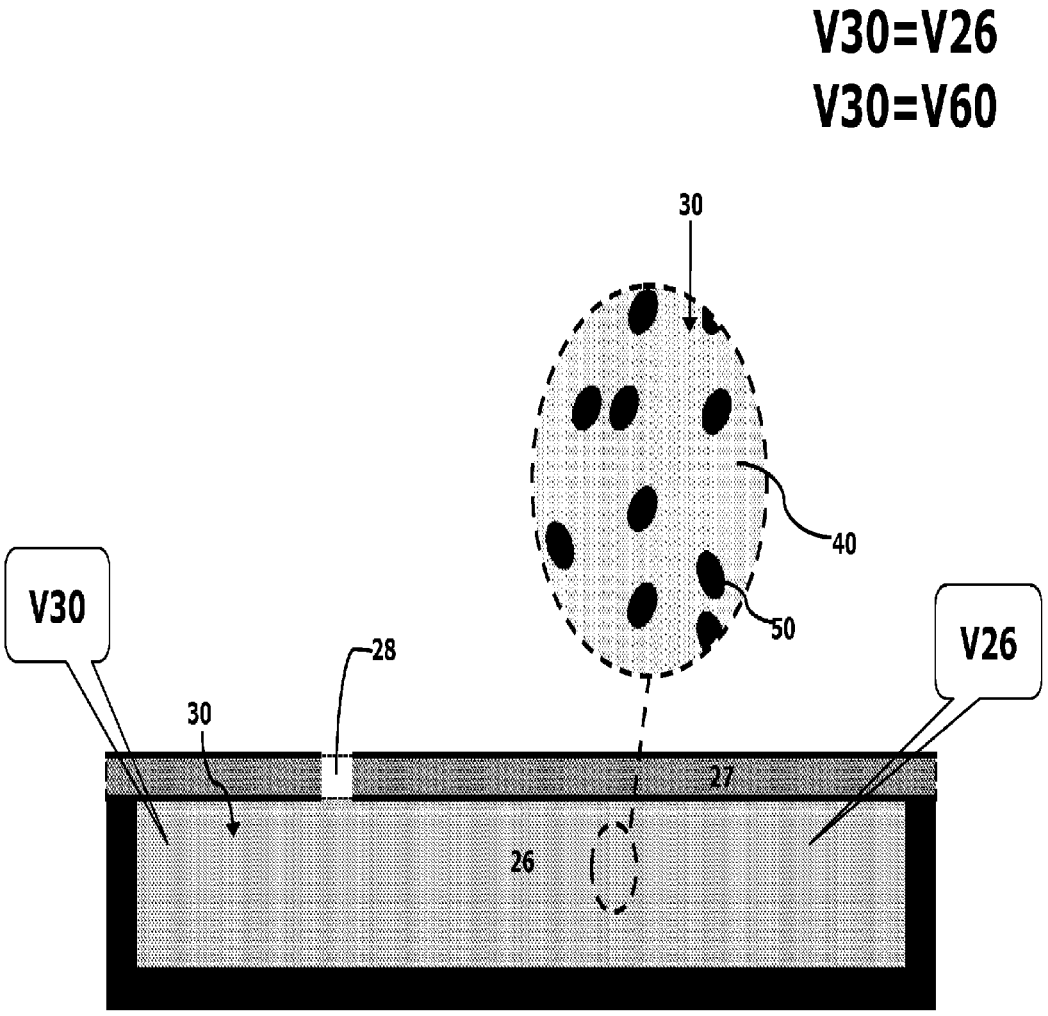
Figure 4J:
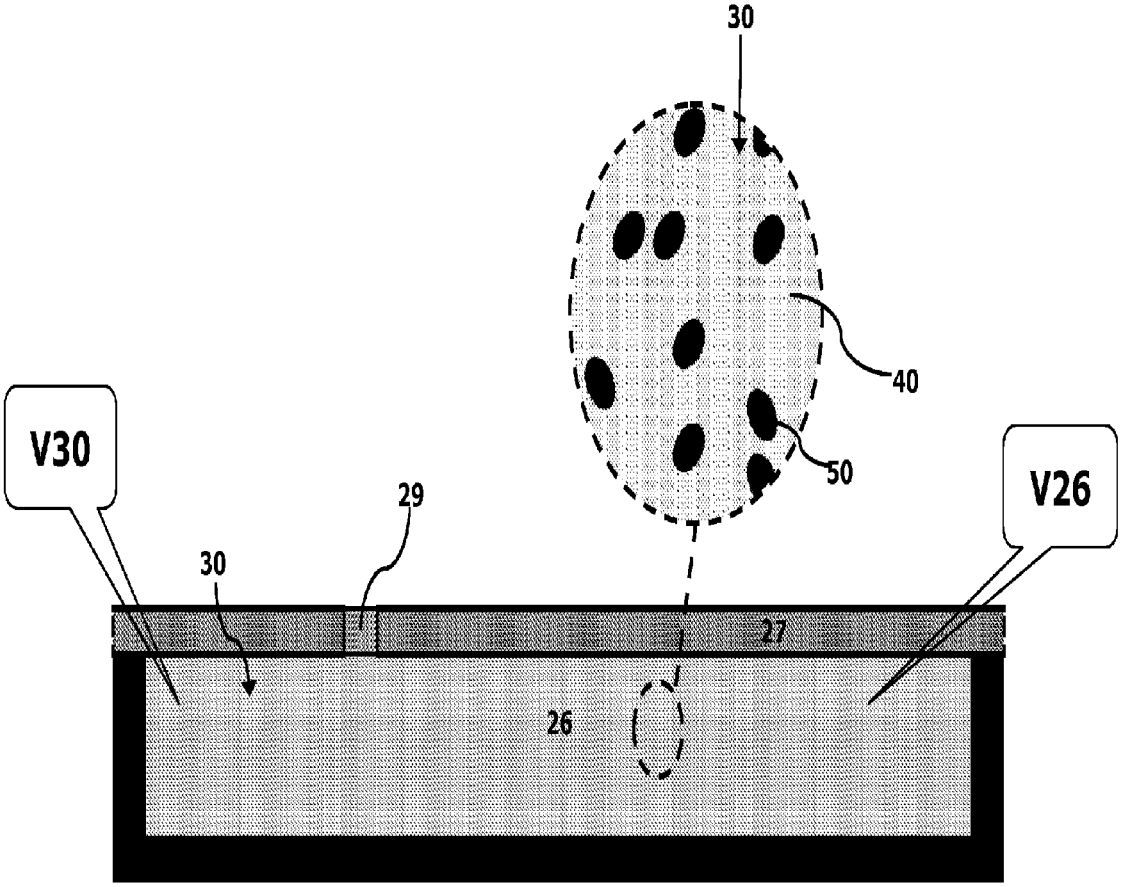
Figure 4K:
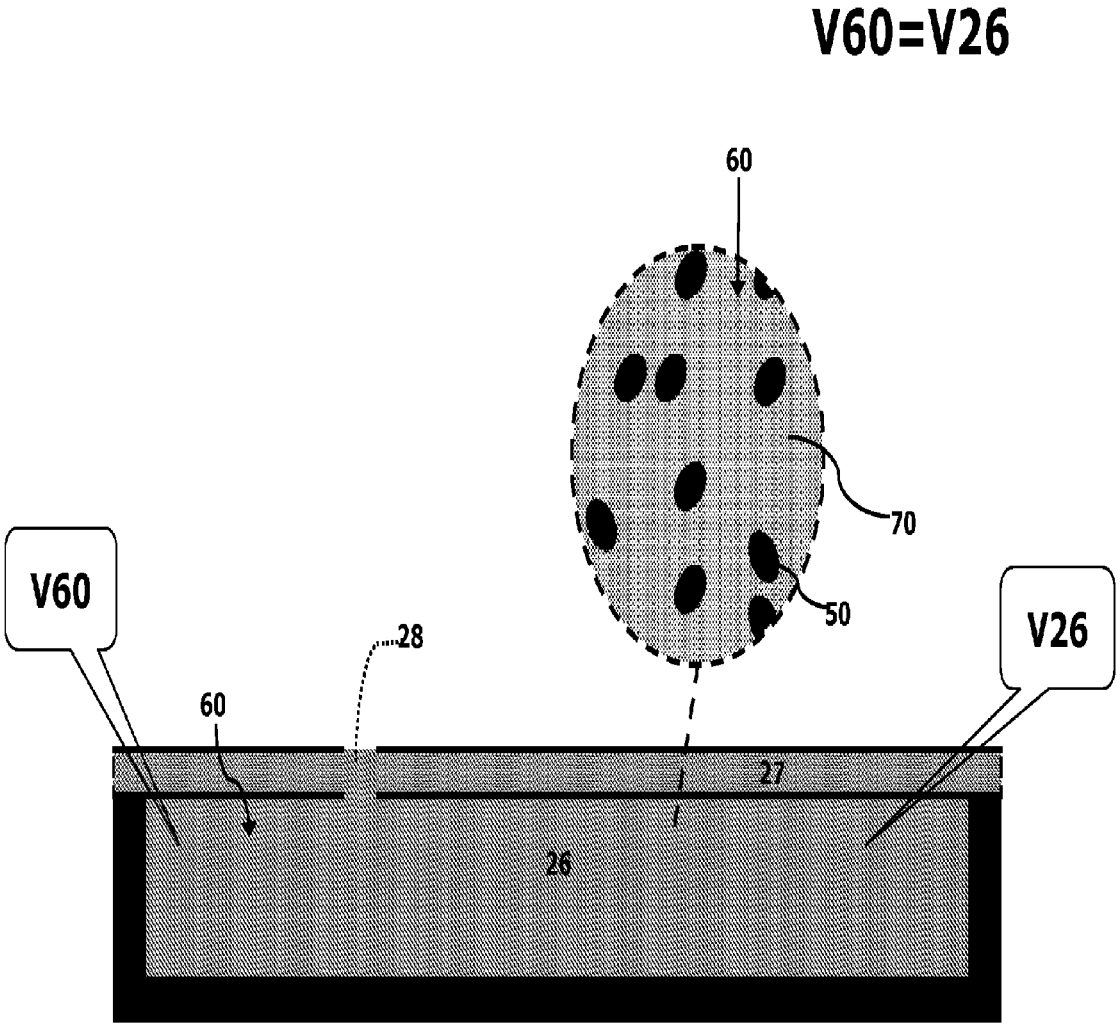
Figure 4L:
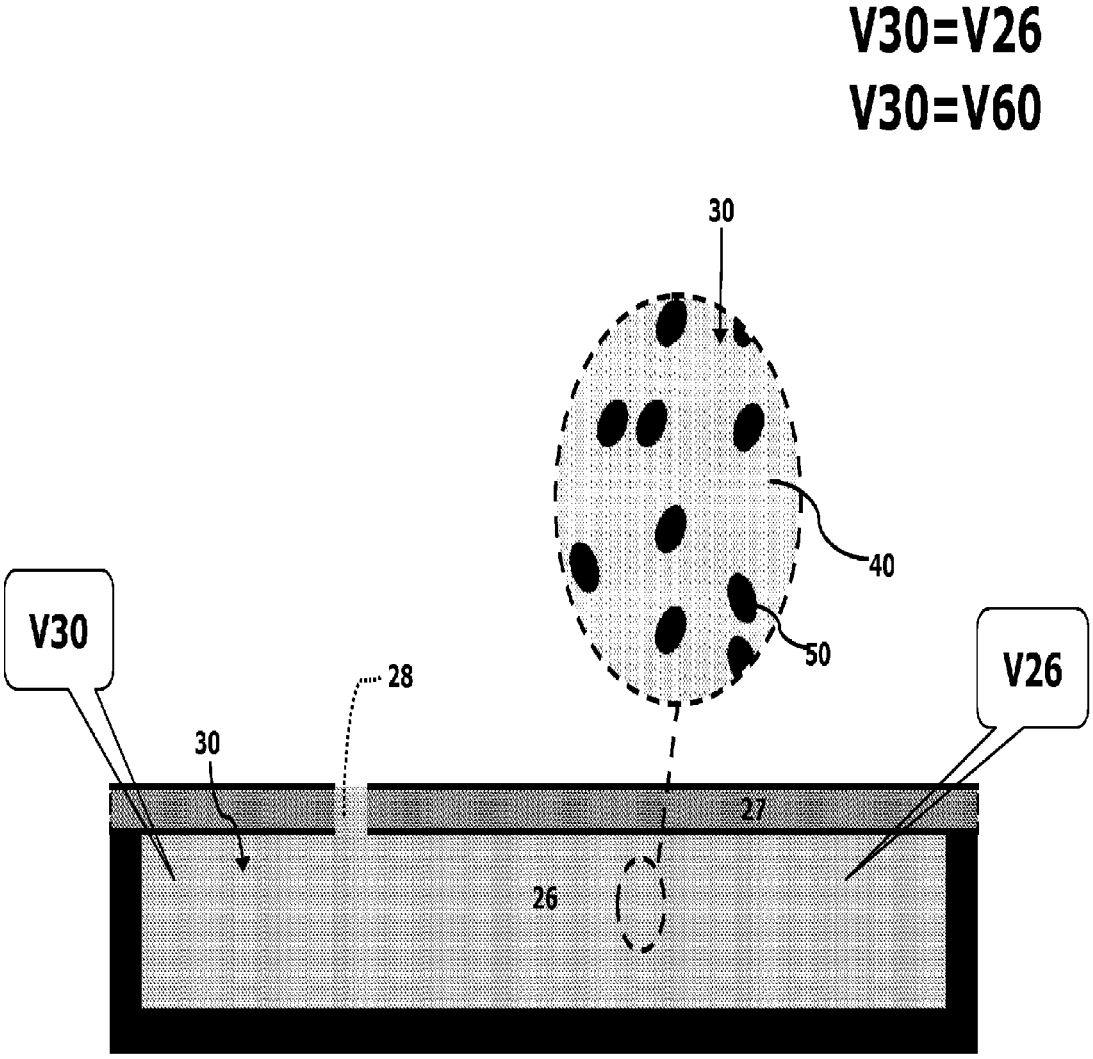
Figure 5A:
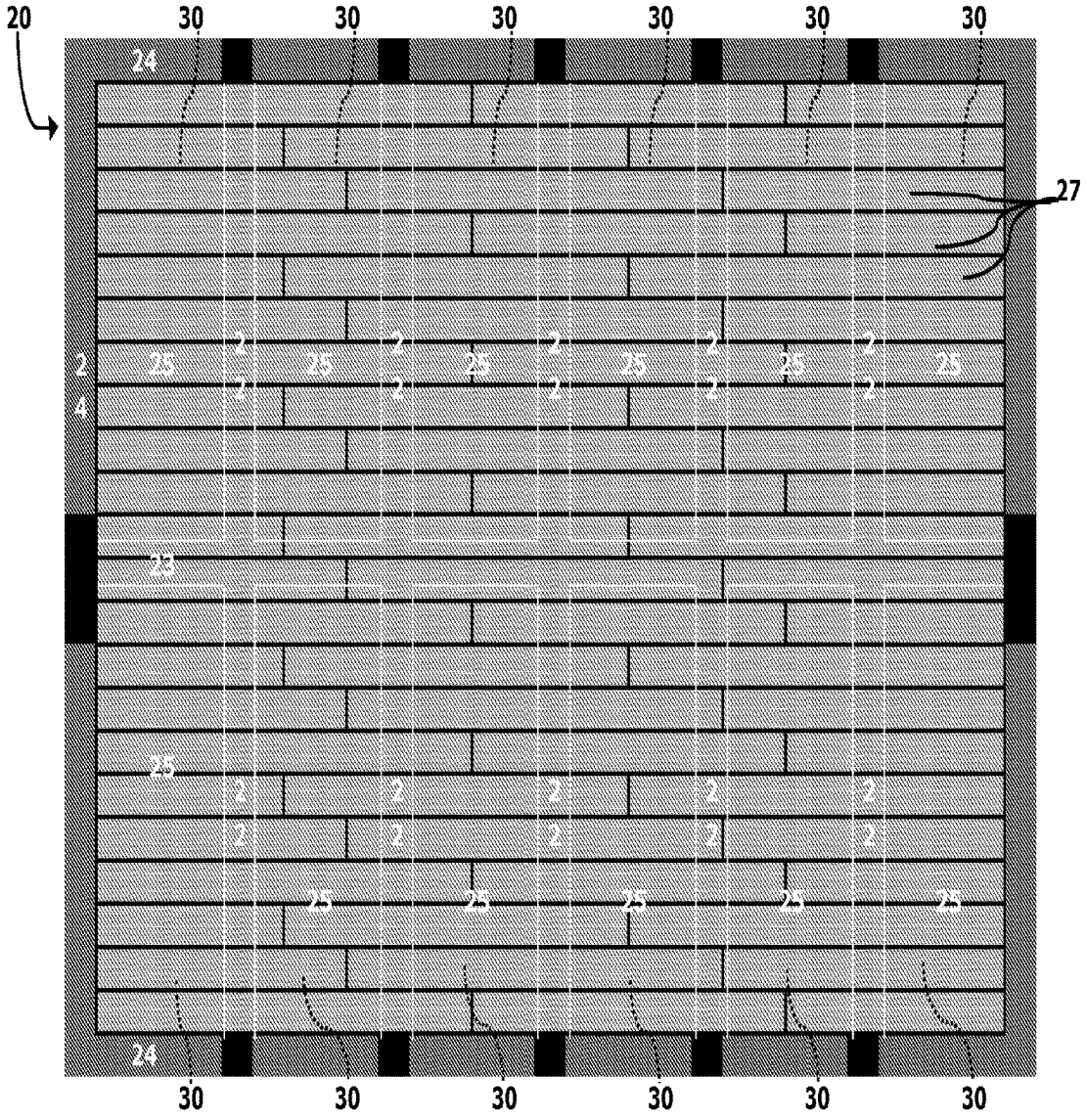
Figure 5B:
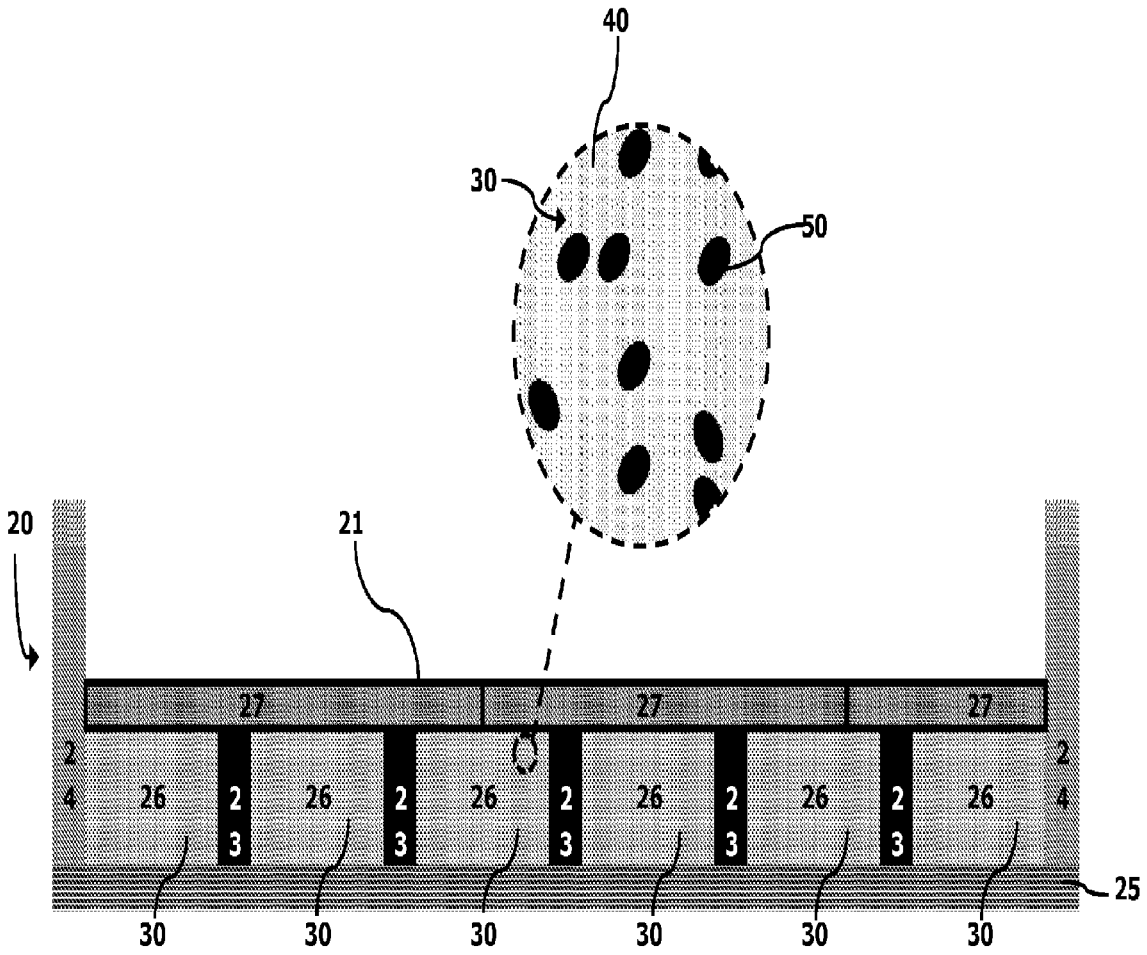
Figure 5C:
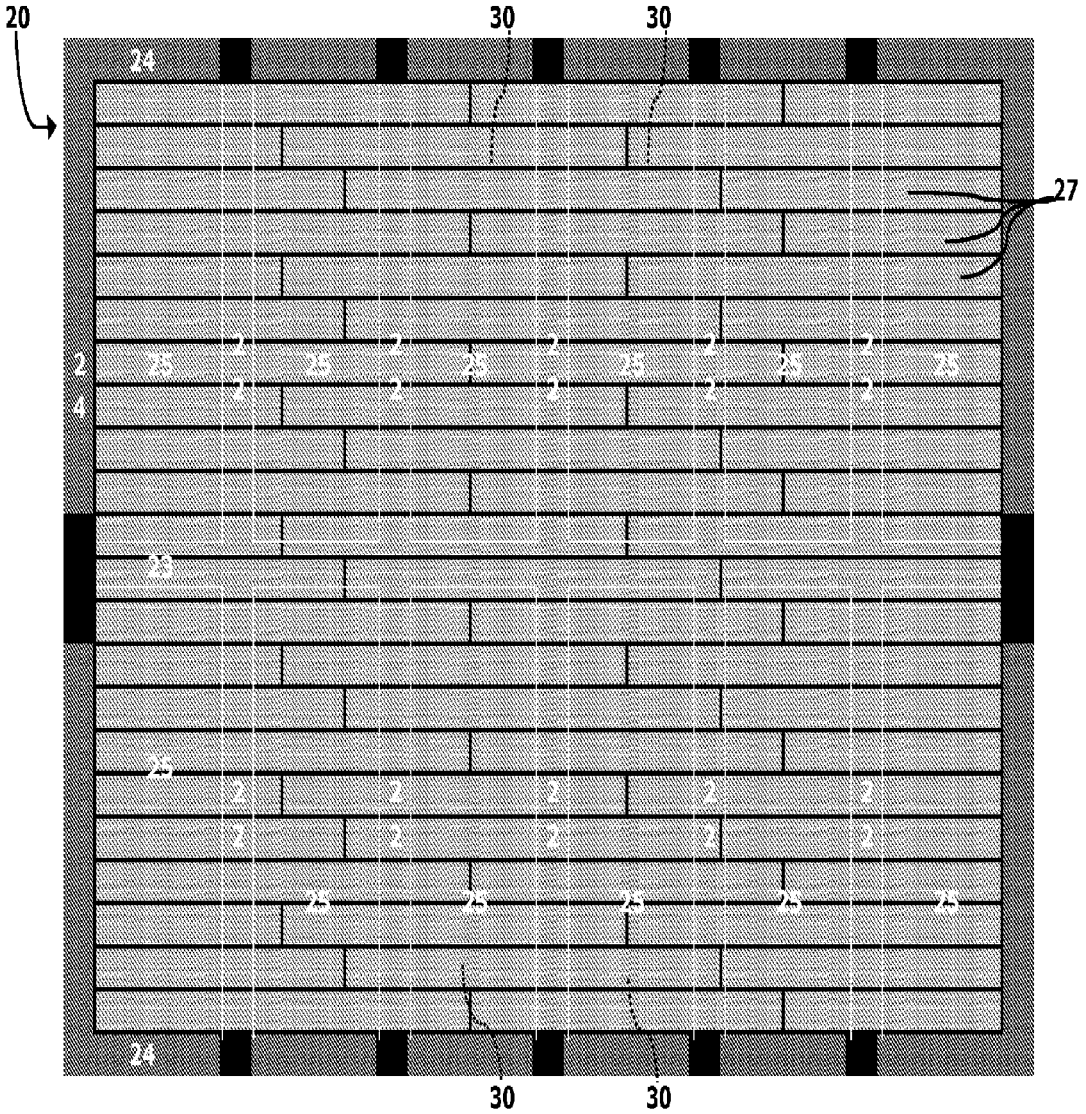
Figure 5D:
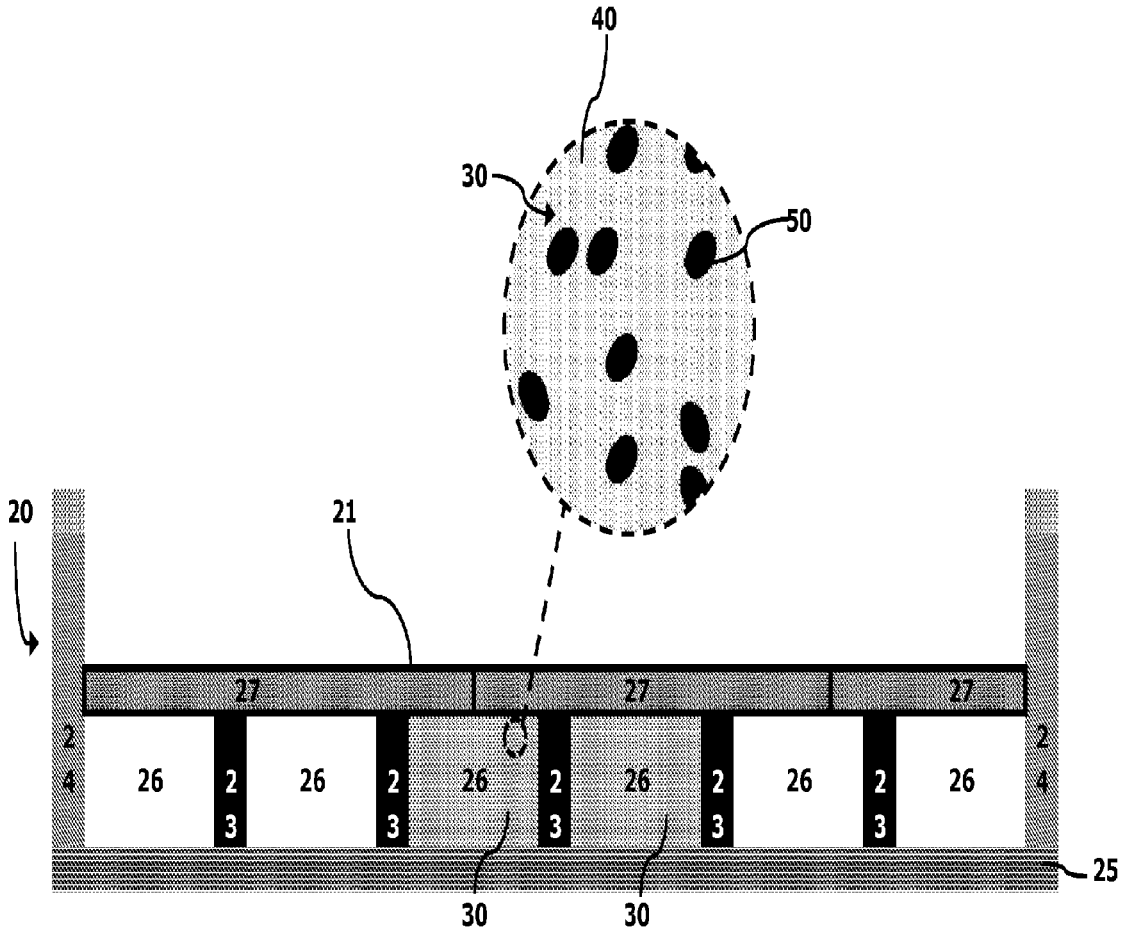
Figure 5E:
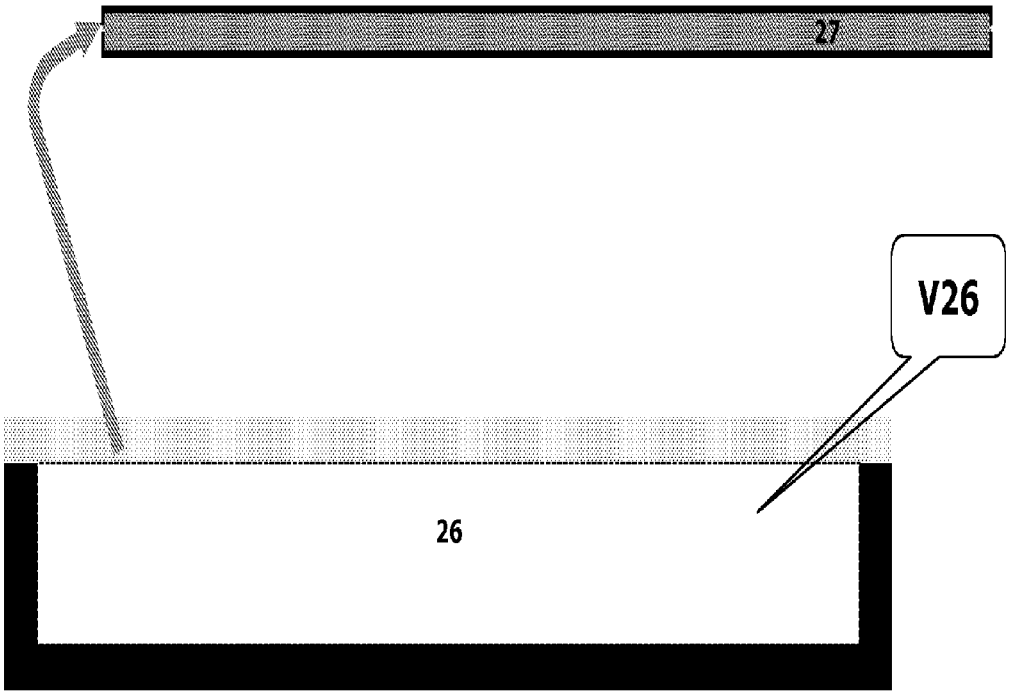
Figure 5F:
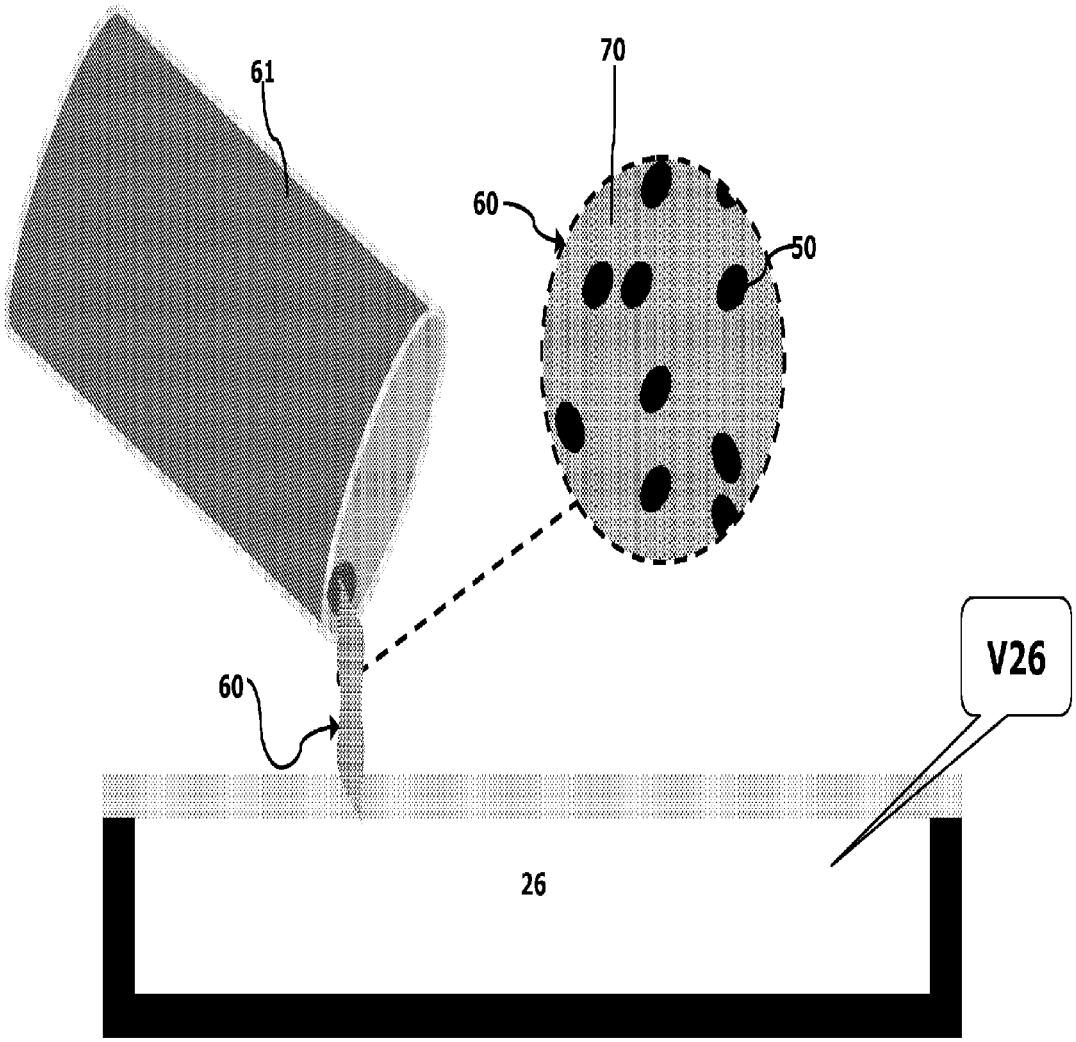
Figure 5G:
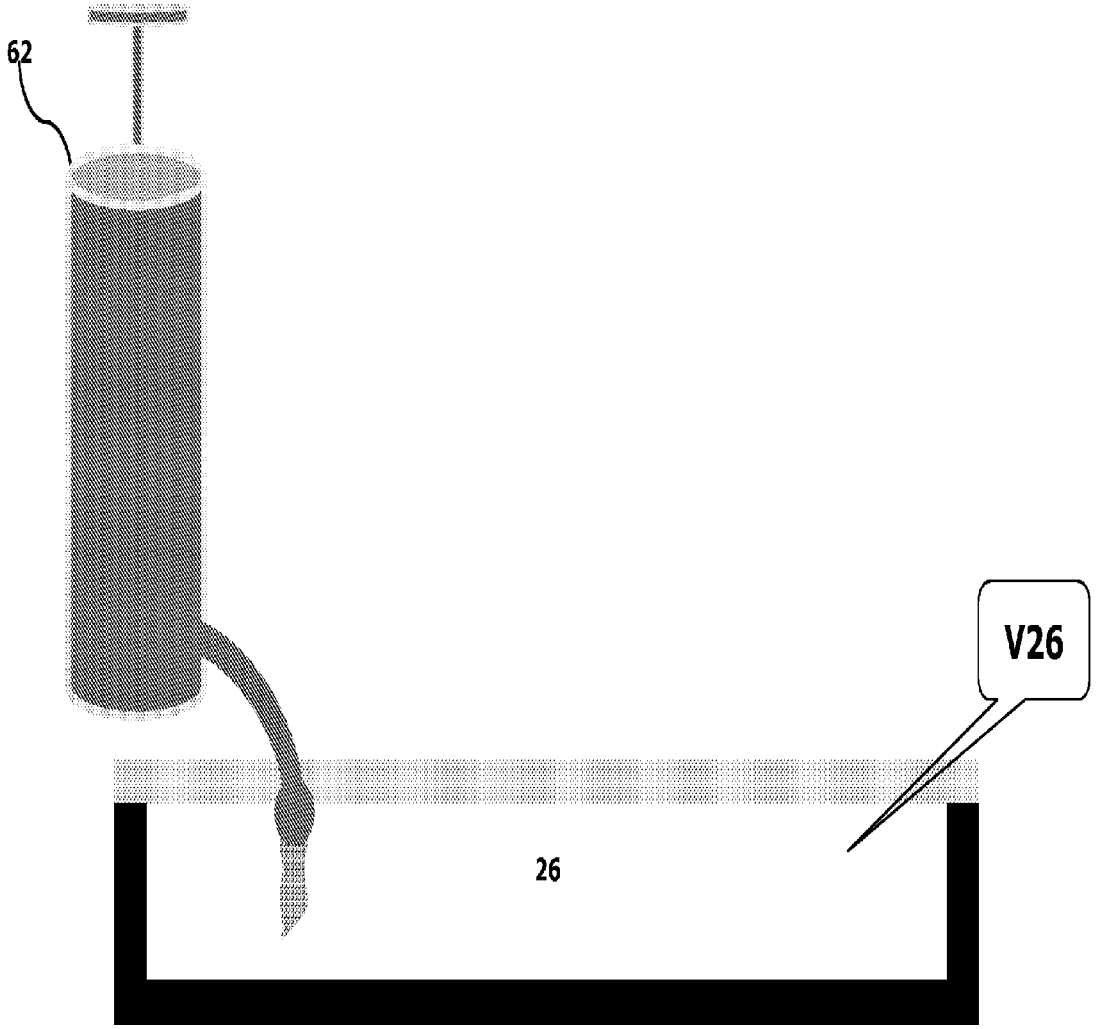
Figure 5H:
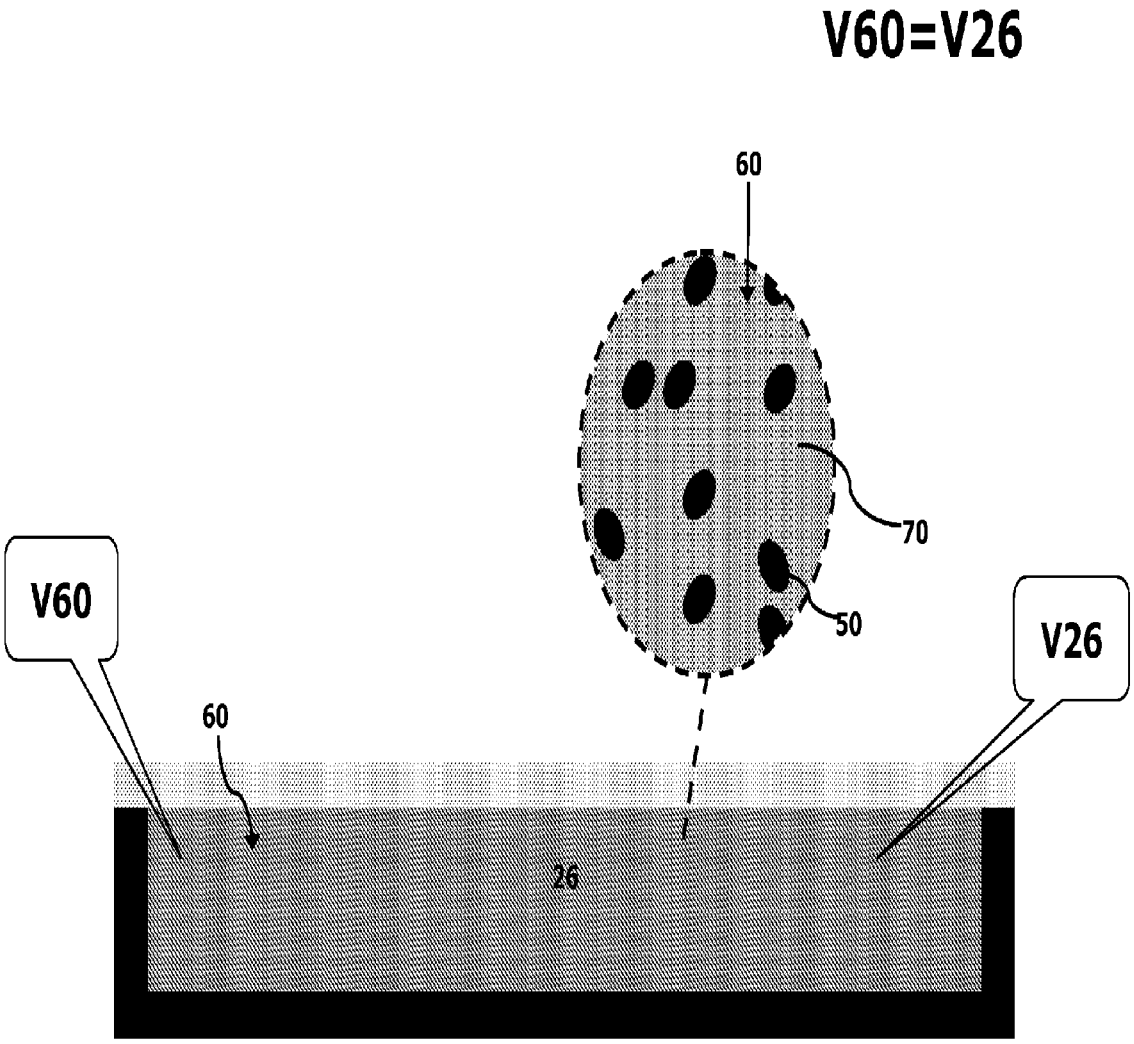
Figure 5I:
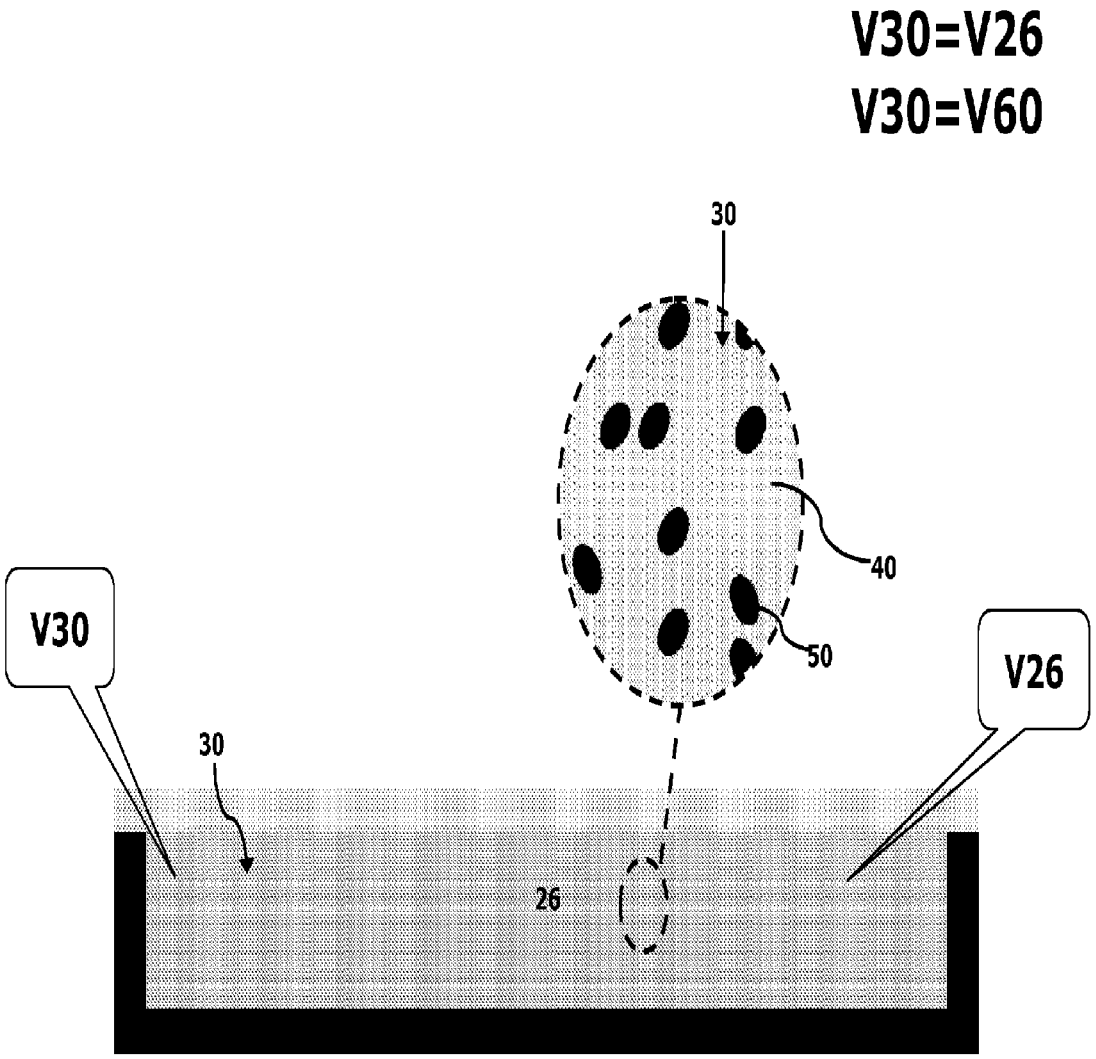
Figure 5J:
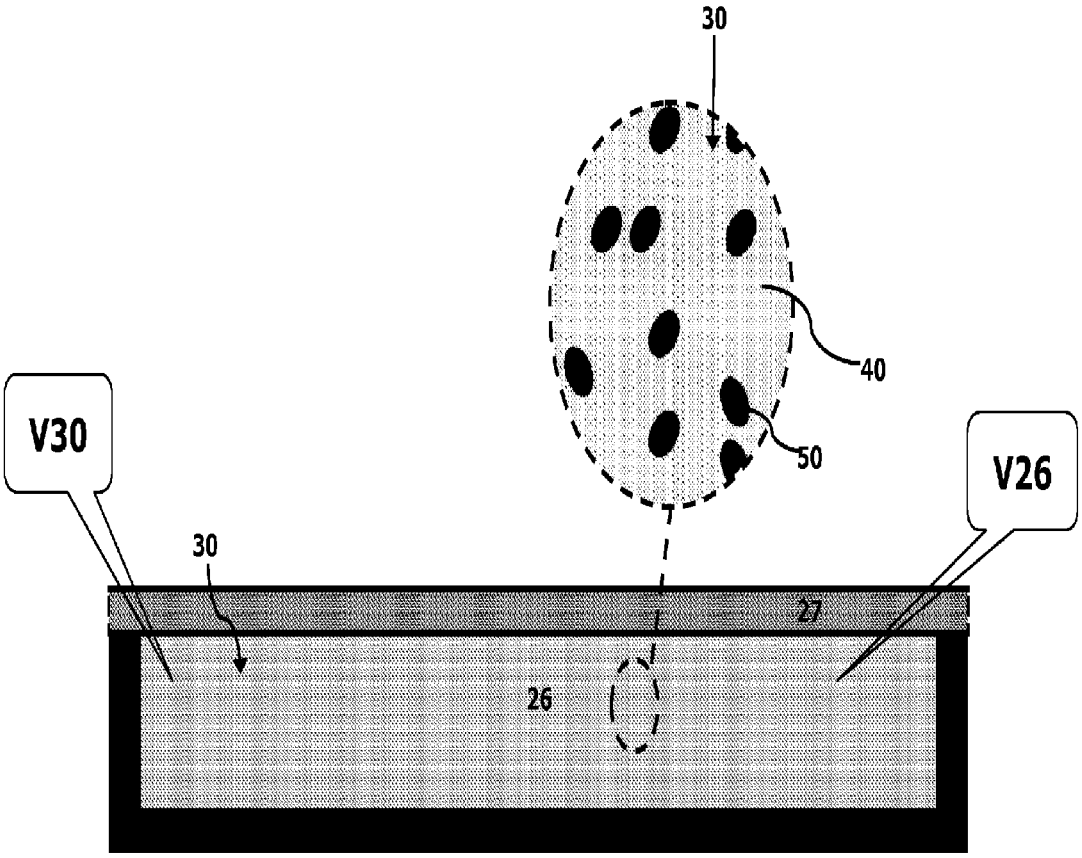
Figure 6A:
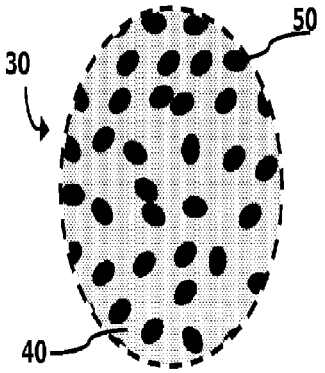
Figure 6A:
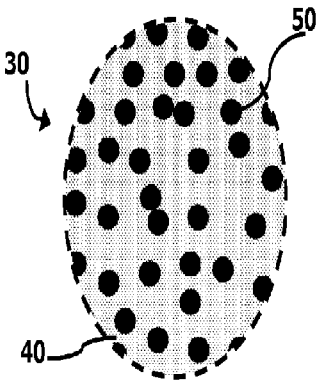
Figure 6A:
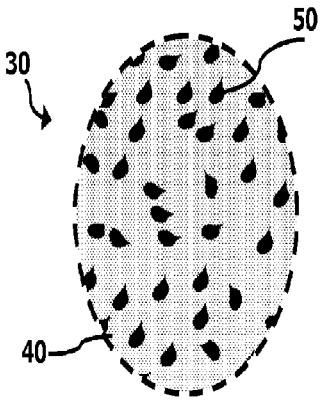
Figure 6A:
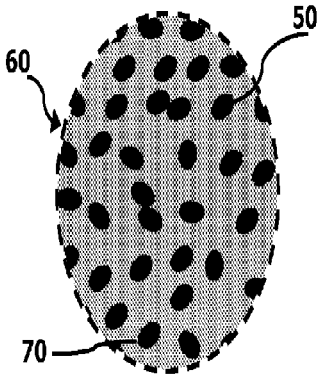
Figure 6B:
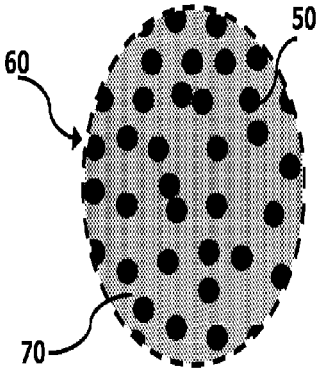
Figure 6C:
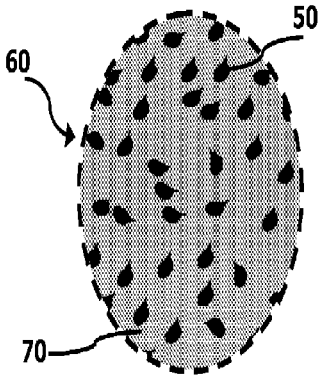
Figure 6D:
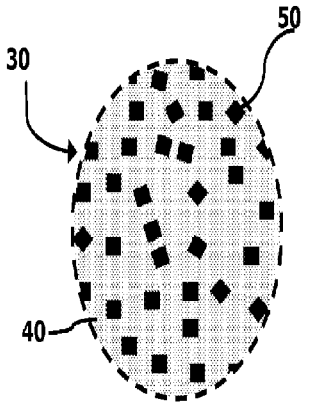
Figure 6D:
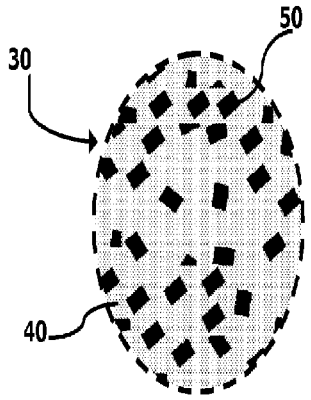
Figure 6D:
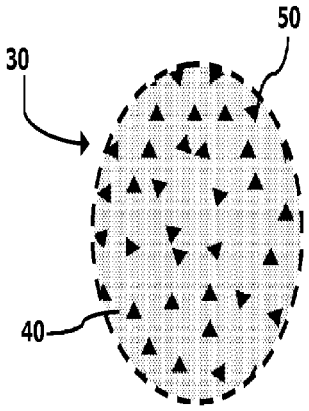
Figure 6D:
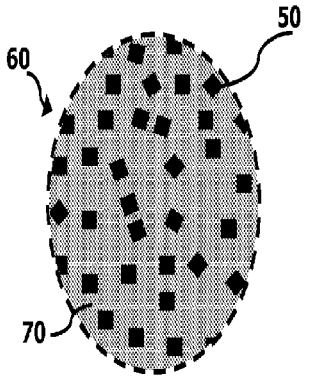
Figure 6E:
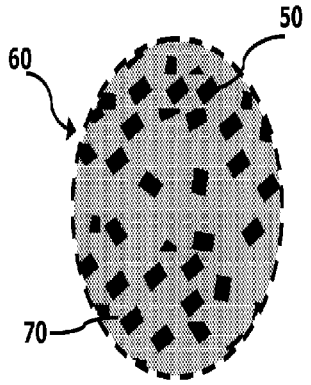
Figure 6F:
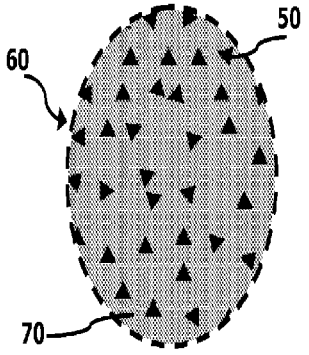
Figure 6G:
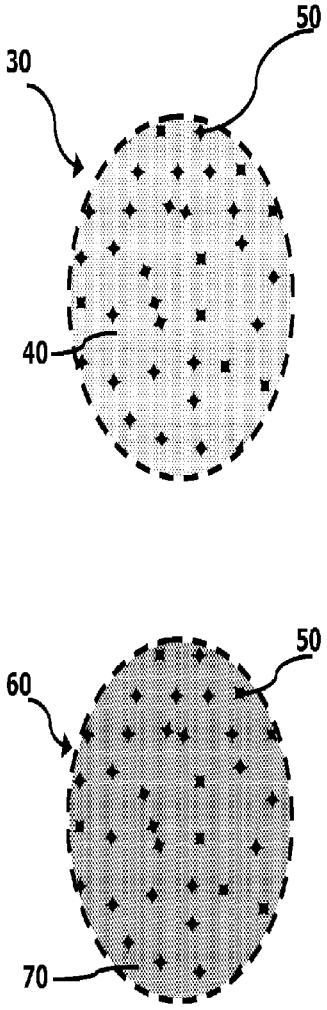
Figure 6H:
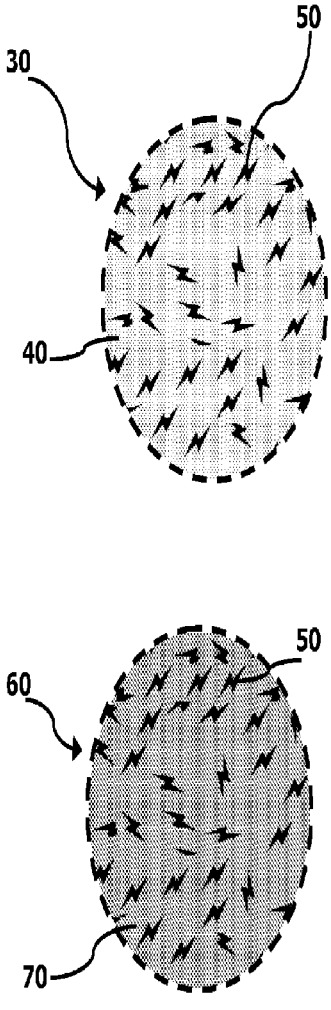
Figure 6I:
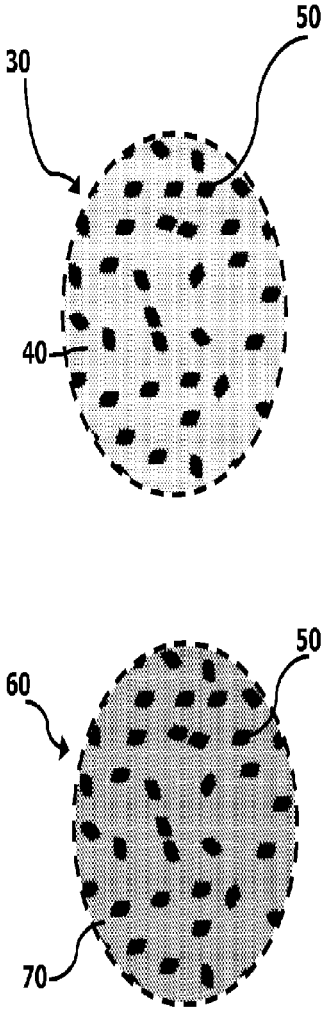
Figure 6J:
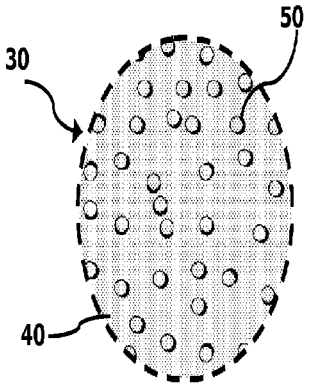
Figure 6J:
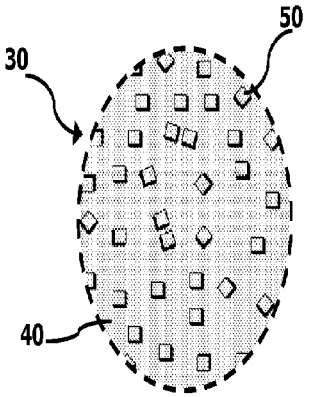
Figure 6J:
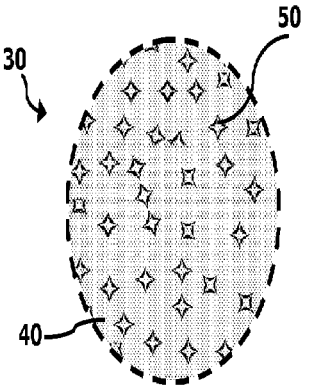
Figure 6J:
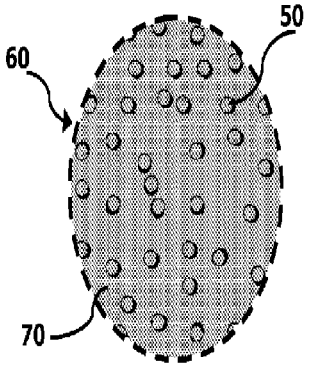
Figure 6K:
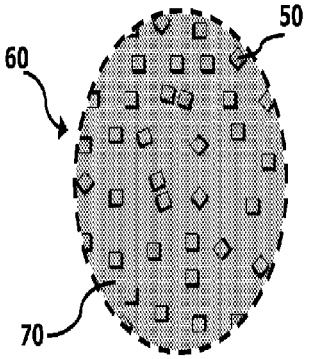
Figure 6L:
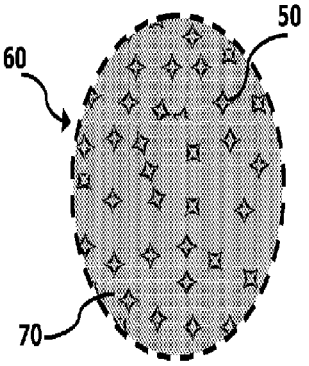

The enclosed cavity assemblies 20 shown in the $4^{th}$ and $5^{th}$ drawing sets are typical of finished floors in existing buildings. In the floor assembly 20 shown in the $4^{th}$ drawing set, a hole 28 can be drilled through the continuous sheet 27 and the pod-making material 60 introduced therethrough (FIGS. 4E-4G). The hole 28 can later be closed by a distinct plug 29 (FIG. 4J). Alternatively, the pod-making material 60 can be overflowed into the hole 28 whereby a nub-like projection from the pod 30 seals this opening. (FIGS. 4K-4L). In the floor assembly 20 shown in the $5^{th}$ drawing set, a segment 27 can be removed to allow pod-making-material introduction and then later be replaced.

The pods 30 are each produced by fluidly introducing a pod-making material 60 into the cavities. The pod-making material 60 can be, for example, poured into the cavity 26 from a receptacle 61 or the material can be pumped into the cavity 26 with a pump 62. The pod-making material 60 can be formulated to possess a viscosity compatible with the desired cavity-introduction technique. Additionally or alternatively, the fluid-introduction technique can be chosen to accommodate the material's viscosity.

When the cavity 26 is filled with the pod-making material 60, the volume V60 of the material 60 will be at least equal to the volume V26 of the filled cavity 26. In the $2^{nd}$, $4^{th}$, and $5^{th}$ drawing sets, the material's volume V60 will be equal to the cavity's volume V26. In the $3^{rd}$ drawing set, the material's volume V60 will be greater than the cavity's volume V26 because of the upper stratums 31.

The pod-making material 60 comprises a liquid carrier 70 with the pellets 50 disseminated therein. A pod 30 is produced by the liquid carrier 70 solidifying within the cavity 26, with the pellets 50 remaining substantially the same size, shape, and specific weight. The pod's volume V30 will be substantially equal to the volume V60 of the material 60. Thus an installer can accurately predict the size/shape of the pod 30 by the material 60 fluidly introduced.

The pod 30 is also dimensionally stable after installation, with its volume V30 remaining substantially the same (e.g., within 5%, within 4%, within 3%, within 2%, within 1%, etc.) for many years (e.g., at least 5 years, at least 10 years, at least 20 years, etc.). The pods 30 do not substantially settle, contract, expand, swell, or otherwise alter. Thus, there will be substantially no sagging, drooping, or bulging of the walkable surface, the filled cavity, and/or the coated structure.

The pods 30 can each have a load-supporting capacity of at least at least 200 psf (at least 10 kPa), at least 300 psf (at least 15 kPa), and/or at least 400 psf (at least 20 kPa).

The lightweight pods 30 can each have a nominal specific gravity of less than about 0.3, less than about 0.2, less than about 0.1. Additionally or alternatively, the pods 30 can each have a specific gravity of between about 0.01 and about 0.5, and/or between about 0.03 and about 0.3.

The pods 30 can individually or collectively function as a sound attenuator (e.g., it can have a sound transmission coefficient (STC) of at least 30). And agents can be incorporated into the pod 30 to allow it to further act as a flame retardant, smoke suppressant, conductive, non-conductive, and/or organism killers (e.g., biocide, fungicide, insecticide, mildeweide, bactericide, rodentcide, etc.). These adaptations and/or incorporations can be accomplished during formulation of the liquid carrier 40 and/or during production of the pellets 50.

The pellets 50 can collectively account for a significant percent of the pod volume V30 and/or the material volume V60 (e.g., at least 50%, at least 60%, at least 70%, at least 75%, at least 80%, at least 85%, at least 90%, and/or at least 95%). The carrier 40/70 can account for a less significant percentage of these volumes (e.g., less than 5%, less than 10%, less than 20%, less than 30%, less than 40%, and/or less than 50%). The sum of the pellet-percentage and the carrier-percentage will never be greater than 100%, but it can be less if additional items are incorporated into the pod material.

The pod 30 is created in the horizontal or vertical cavity, surface, or coated structure by the liquid carrier 70 solidifying to form the solid binder 40.

The carrier 40/70 can comprise a binder or an adhesive (e.g., epoxy, latex, emulsion, urethane, polyvinyl acetate, polyester, mineral silicate, etc.) or other oleoresinous or water-based systems. Solidification can additionally or alternatively be attained by chemical curing, oxidation, and/or radiation exposure (e.g., ultraviolet or electrobeam).

The pellets 50 comprise a multitude of bodies which would each be a distinct and separable entity if not for the carrier 40/70. Depending upon their shapes, the pellets 50 can also be called beads, microspheres, balls, capsules, particles, granules, grains, chips, chunks, morsels, and other similar terms. The pellet geometry can be such that no one dimension dominates another by more than three-fold and/or five-fold. In the case of the oblong pellets 50 shown in the $2^{nd}$ through $5^{th}$ drawing sets, for example, their axial lengths are not more than three times their central diameters.

As shown in the $6^{th}$ through $9^{th}$ drawing sets, the pellets 50 can assume many different geometries, including rounded, polygonal, starred, and other regular, semi-regular, and irregular shapes. The pellets 50 can be substantially the same shape and/or substantially the same size, or they can be of different shapes and/or sizes. Additionally or alternatively, the pellets 50 can be solid and/or they can be hollow.

The pellets 50 can have average pellet dimensions of less than about 0.5 inch (about 12 mm), less than about 0.4 inch (about 10 mm), less than about 0.3 inch (about 8 mm), less than about 0.2 inch (about 6 mm), and/or less than about 0.1 inch (about 3 mm). In most cases, the pellets 50 will have average pellet dimensions greater than about 0.075 inch (about 2 mm). And in many cases, the pellets 50 will have average pellet dimensions between about 0.075 inch and about 0.20 inch (about 2 mm and 6 mm).

If the pellets 50 are hollow microspheres or other similar micro particles, their dimensions will be much smaller than set forth in the preceding paragraph. A suitable glass, silicate, mineral or ceramic microsphere could have an average particle size of 150 microns, 70 microns, 40 microns and/or 10 microns, for example.

The pellets 50 can have a low specific gravity (e.g., less than 0.30, less than 0.20, less than 0.10, less than 0.05, less than 0.04, less than 0.03, less than 0.02, less than 0.01, etc.) so as to achieve a light-weight pod in spite of a heavy carrier 40/70.

The pellets 50 can comprise expanded polymer, expanded mineral, expanded ceramic, biomass, crumb rubber, polymeric scrap materials, and combinations thereof. The preferred form of the pellets 50 can comprise, for example, mufti-cellular and/or closed cell polymer beads or hollow microspheres.

As was indicated above, the pellets 50 remain substantially the same size, shape, and specific gravity when the liquid carrier 70 solidifies to form the pod 30. To this end, the pellets 50 can be non-porous with respect to the carrier 40/70. Non-porosity can be accomplished by pellet composition, pellet formation, non-porous coating, or any other suitable technique.

Although the building 10, the floor assembly 20, the pod 30, the solidified carrier 40, the pellets 50, the material 60, and/or the liquid carrier 70 have been have been shown and described as having certain forms and fabrications, such portrayals are not quintessential and represent only some of the possible of adaptations of the claimed characteristics. Other obvious, equivalent, and/or otherwise akin embodiments could instead be created using the same or analogous attributes. For example, although the building 10 was depicted as a residential home with an attic 12, the floor assembly 20 can be integrated into other buildings and non-buildings with walkable surfaces 21 (e.g., patios, sidewalks, roads, vehicles, etc.).

Additionally or alternatively, although the walkable surface 21 was portrayed primarily as horizontal, non-vertical sloped orientations are also possible and probable, such as with ramps and slides, as well as vertical wall structures, surfaces, and cavities. The pod material is supplied as a pumpable or sprayable insulation product having obvious advantages as a structurally stable and durable composition. Other uses could include housings for HVAC equipment, machinery, industrial storage tanks, process tanks, pressure vessels, transportation vehicles, and pipelines.

What is claimed is:

1. A method of forming a structural assembly having a load-supporting rigid surface and an insulating stratum below or behind the load-supporting rigid surface, the method comprising:

forming a fluid pod-making material by mixing a liquid carrier with pellets such that the pellets are disseminated within the liquid carrier, the liquid carrier comprising a binder or an adhesive, the pellets accounting for at least 50% of a volume of the fluid pod-making material, the liquid carrier comprising a material selected from a group comprising epoxy, latex, emulsion, urethane, polyvinyl acetate, polyester, and mineral silicate;

providing a floor or support surface having one or more structural members supported relative to a deck member, the one or more structural members spaced apart to define a plurality of cavities arranged in a grid in the floor or on the support surface of the structural assembly;

introducing the fluid pod-making material into the plurality of cavities; and solidifying the fluid pod-making material to form a solidified pod within the cavity, the solidified pod non-covered and defining the load-supporting rigid surface at a top of the cavity opposite the deck member, the solidified pod structurally contributing to a load-supporting capacity of the floor or support surface, the load-supporting capacity of the load-supporting rigid surface being at least 100 pounds per square foot (psf).

2. The method of claim 1, wherein the step of introducing the fluid pod-making material comprises pouring the fluid pod-making material into the plurality of cavities or onto the support surface.

3. The method of claim 1, wherein the step of introducing the fluid pod-making material comprises pumping the fluid pod-making material into the plurality of cavities or onto the support surface.

4. The method of claim 1, wherein the step of introducing the fluid pod-making material comprises spraying the fluid pod-making material into the plurality of cavities or onto the support surface.

5. The method of claim 1, wherein the load-supporting capacity of the load-supporting rigid surface is at least 200 pounds per square foot (psf).

6. The method of claim 1, wherein the pod has an R value of at least 2.

7. The method of claim 1, wherein the insulating stratum is positioned between the load-supporting rigid surface of the pod and the deck member.

8. The method of claim 1, wherein the floor or cavity comprises a wall, a ceiling, a roof, or attic.

9. The method of claim 1, wherein the liquid carrier comprises a material selected from a group comprising an acrylic, a silicone, an oleoresinous vehicle, a water reducible resin, and a coupling agent.

10. The method of claim 1, wherein the step of solidifying the fluid pod-making material comprises solidifying by a chemical curing process.

11. The method of claim 1, wherein the step of solidifying the fluid pod-making material comprises solidifying by an oxidation process.

12. The method of claim 1, wherein the step of solidifying the fluid pod-making material comprises solidifying by radiation exposure.

13. A method of forming a structural assembly having a load-supporting rigid surface and an insulating stratum below or behind the load-supporting rigid surface, the method comprising:

forming a fluid pod-making material by mixing a liquid carrier with pellets such that the pellets are disseminated within the liquid carrier, the liquid carrier comprising a material selected from a group comprising epoxy, latex, emulsion, urethane, polyvinyl acetate, polyester, and mineral silicate;

introducing the fluid pod-making material into a cavity or onto a support surface, the cavity defined between one or more structural members; and solidifying the fluid pod-making material to form a pod within the cavity or on the support surface, the solidified pod defining the load-supporting rigid surface, the load-supporting capacity of the load-supporting rigid surface being at least 100 pounds per square foot (psf).

14. The method of claim 13, wherein the step of introducing the fluid pod-making material comprises pouring the fluid pod-making material into the plurality of cavities or onto the support surface.

15. The method of claim 13, wherein the step of introducing the fluid pod-making material comprises pumping the fluid pod-making material into the plurality of cavities or onto the support surface.

16. The method of claim 13, wherein the step of introducing the fluid pod-making material comprises spraying the fluid pod-making material into the plurality of cavities or onto the support surface.

17. The method of claim 13, wherein the pod has an R value of at least 2.

18. A method of forming a structural assembly having a load-supporting rigid surface and an insulating stratum below or behind the load-supporting rigid surface, the method comprising:

forming a fluid pod-making material by mixing a liquid carrier with pellets such that the pellets are disseminated within the liquid carrier;

introducing the fluid pod-making material into a cavity, the cavity defined between one or more structural members and above a deck member, the fluid pod-making material introduced into the cavity by one of:
pouring the pod-making material into the cavity;
pumping the pod-making material into the cavity; or
spraying the pod-making material into the cavity; and solidifying the fluid pod-making material to form a pod within the cavity, the solidified pod non-covered and defining the load-supporting rigid surface at a top of the cavity opposite the deck member, the solidified pod structurally contributing to a load-supporting capacity, the load-supporting capacity of the load-supporting rigid surface being at least 100 pounds per square foot (psf), wherein the pod has a specific gravity that is less than about 0.3.

19. The method of claim 18, wherein the pod has an R value of at least 2.

20. The method of claim 18, wherein the specific gravity is between about 0.03 and about 0.3.

* * * * *